US009180670B2

(12) United States Patent
Ogawa

(10) Patent No.: US 9,180,670 B2
(45) Date of Patent: Nov. 10, 2015

(54) LIQUID EJECTION APPARATUS, METHOD, AND NON-TRANSITORY, COMPUTER-READABLE MEDIUM FOR CONTROLLING LIQUID EJECTION APPARATUS

(71) Applicant: Mikio Ogawa, Nagoya (JP)

(72) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/142,675

(22) Filed: Dec. 27, 2013

(65) Prior Publication Data

US 2014/0247303 A1 Sep. 4, 2014

(30) Foreign Application Priority Data

Dec. 28, 2012 (JP) ..... 2012-288991
Dec. 28, 2012 (JP) ..... 2012-288993

(51) Int. Cl.
*B41J 2/165* (2006.01)

(52) U.S. Cl.
CPC ..... *B41J 2/16511* (2013.01); *B41J 2/16532* (2013.01); *B41J 2/16585* (2013.01); *B41J 2002/16514* (2013.01); *B41J 2002/16573* (2013.01)

(58) Field of Classification Search
CPC .. B41J 2/1707; B41J 2/17596; B41J 2/16523; B41J 2/16573; B41J 2002/16573
USPC ..... 347/30
See application file for complete search history.

(56) References Cited

U.S. PATENT DOCUMENTS

| | | | | |
|---|---|---|---|---|
| 7,410,248 | B2 * | 8/2008 | Umeda et al. | 347/85 |
| 7,828,408 | B2 * | 11/2010 | Miyazawa | 347/22 |
| 2002/0186271 | A1 * | 12/2002 | Yamada et al. | 347/30 |
| 2003/0184612 | A1 * | 10/2003 | Umeda | 347/30 |
| 2007/0257959 | A1 | 11/2007 | Miyazawa | |
| 2008/0143764 | A1 * | 6/2008 | Kaga et al. | 347/7 |
| 2009/0051728 | A1 * | 2/2009 | Miyazawa | 347/30 |
| 2010/0302309 | A1 * | 12/2010 | Hatta et al. | 347/32 |
| 2011/0242205 | A1 * | 10/2011 | Ogawa | 347/29 |

FOREIGN PATENT DOCUMENTS

| | | | |
|---|---|---|---|
| JP | H10-181034 | A | 7/1998 |
| JP | 2007-301991 | A | 11/2007 |
| JP | 2010-125746 | A | 6/2010 |

OTHER PUBLICATIONS

State Intellectual Property Office of the People's Republic of China, Notification of First Office Action issued for Chinese Patent Application No. 201310741583.9 (foreign counterpart of above-captioned patent application), mailed May 18, 2015.

* cited by examiner

*Primary Examiner* — Matthew Luu
*Assistant Examiner* — Patrick King
(74) *Attorney, Agent, or Firm* — Baker Botts L.L.P.

(57) ABSTRACT

A liquid ejection apparatus includes a liquid ejection head having a plurality of nozzle units, a plurality of capping devices, a movement mechanism, a plurality of suctioning tubes, a suctioning mechanism, a connection device, and a control device. The control device controls the suctioning mechanism to suction fluid in the capping device corresponding to one of the nozzle units and the capping device corresponding to a different one of the nozzle units. In response to expiration of a predetermined time period, which is a predetermined amount of time that the suctioning mechanism generates a suctioning force, the control device controls to disconnect the capping device corresponding to the one of the nozzle units from the suctioning mechanism.

17 Claims, 17 Drawing Sheets

| PORT | STATE |
|---|---|
| A | SUCTIONING |
| B | BLOCKED |
| C | BLOCKED |
| D | BLOCKED |
| E | BLOCKED |
| F | BLOCKED |

| PORT | STATE |
|---|---|
| A | IDLE SUCTIONING |
| B | PRELIMINARY SUCTIONING |
| C | BLOCKED |
| D | BLOCKED |
| E | BLOCKED |
| F | BLOCKED |

| PORT | STATE |
|---|---|
| A | BLOCKED |
| B | SUCTIONING |
| C | BLOCKED |
| D | BLOCKED |
| E | BLOCKED |
| F | BLOCKED |

| PORT | STATE |
|---|---|
| A | BLOCKED |
| B | BLOCKED |
| C | BLOCKED |
| D | BLOCKED |
| E | IDLE SUCTIONING |
| F | PRELIMINARY SUCTIONING |

| PORT | STATE |
|---|---|
| A | BLOCKED |
| B | BLOCKED |
| C | BLOCKED |
| D | BLOCKED |
| E | BLOCKED |
| F | SUCTIONING |

| PORT | STATE |
|---|---|
| A | BLOCKED |
| B | BLOCKED |
| C | BLOCKED |
| D | BLOCKED |
| E | BLOCKED |
| F | IDLE SUCTIONING |

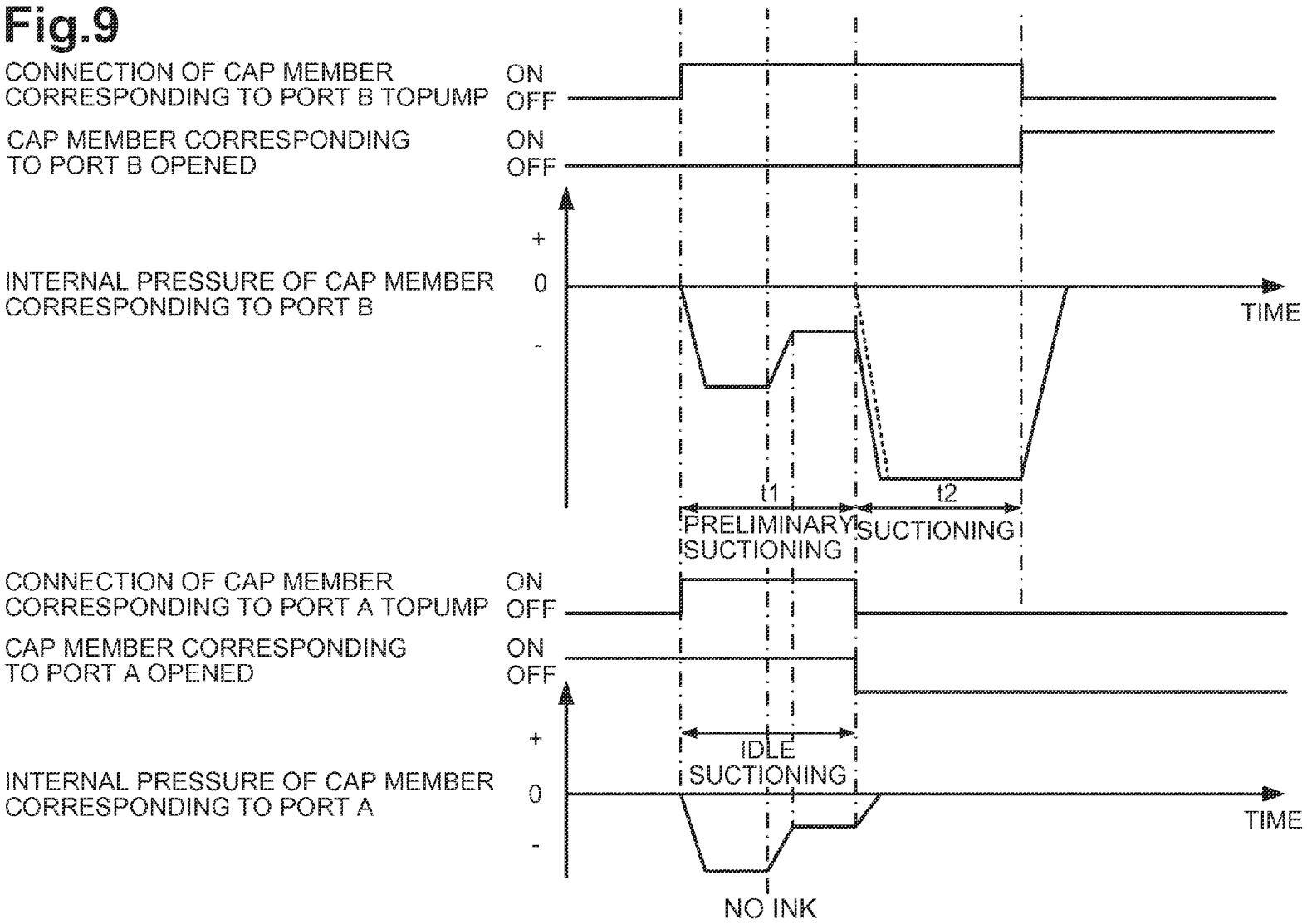
Fig.9
CONNECTION OF CAP MEMBER CORRESPONDING TO PORT B TOPUMP
ON
OFF
CAP MEMBER CORRESPONDING TO PORT B OPENED
ON
OFF
INTERNAL PRESSURE OF CAP MEMBER CORRESPONDING TO PORT B
+
0
-
TIME
t1
t2
PRELIMINARY SUCTIONING
SUCTIONING
CONNECTION OF CAP MEMBER CORRESPONDING TO PORT A TOPUMP
ON
OFF
CAP MEMBER CORRESPONDING TO PORT A OPENED
ON
OFF
INTERNAL PRESSURE OF CAP MEMBER CORRESPONDING TO PORT A
+
0
-
TIME
IDLE SUCTIONING
NO INK

| PORT | STATE |
|---|---|
| A | BLOCKED |
| B | SUCTIONING |
| C | BLOCKED |
| D | BLOCKED |
| E | BLOCKED |
| F | BLOCKED |

| PORT | STATE |
|---|---|
| A | PRELIMINARY SUCTIONING |
| B | IDLE SUCTIONING |
| C | BLOCKED |
| D | BLOCKED |
| E | BLOCKED |
| F | BLOCKED |

| PORT | STATE |
|---|---|
| A | SUCTIONING& IDLE SUCTIONING |
| B | BLOCKED |
| C | BLOCKED |
| D | BLOCKED |
| E | BLOCKED |
| F | BLOCKED |

LIQUID EJECTION APPARATUS, METHOD, AND NON-TRANSITORY, COMPUTER-READABLE MEDIUM FOR CONTROLLING LIQUID EJECTION APPARATUS

CROSS-REFERENCE TO RELATED APPLICATION

This application claims priority from Japanese Patent Applications Nos. 2012-288991 and 2012-288993 filed on Dec. 28, 2012, which are incorporated herein by reference.

FIELD OF DISCLOSURE

The disclosure relates generally to a liquid ejection apparatus configured to eject liquid from nozzles, a method of maintaining the liquid ejection apparatus, and a non-transitory, computer-readable medium for controlling the liquid ejection apparatus.

BACKGROUND

An inkjet printer includes inkjet heads, each having a nozzle surface. The nozzle surfaces of the inkjet heads are covered or sealed with corresponding head caps. One suctioning pump is sequentially connected to the head caps to suction ink from nozzles of the inkjet heads. Viscous ink in internal passages of the inkjet heads, including the nozzles, is discharged into the head caps. Thus, ink ejection performance of the inkjet heads is improved.

SUMMARY

In the inkjet printer, if ink discharged into the head cap is dried, the dried ink may close or clog a passage from the head cap to the suctioning pump. Therefore, after ink is discharged into the head cap, it is desirable to continue the suctioning of ink with the suctioning pump, with the head cap open, to discharge ink stored in the head cap to, for example, a waste ink tank (e.g., to perform a so-called idle suctioning). However, if the suctioning of ink from the nozzles of the inkjet head and the idle suctioning of ink discharged into the head cap are performed sequentially with respect to a plurality of the head caps, the time required to recover ink ejection performance for the inkjet heads increases.

The disclosure relates to a liquid ejection apparatus in which time required to recover a liquid ejection performance may be reduced and a computer-readable medium for controlling the liquid ejection apparatus.

According to one aspect of the disclosure, suctioning may be performed in a first state, so that pressure in a capping device, which may be in a sealing state, may be brought into negative pressure at the same time as when liquid remaining in another capping device, which may be in an unsealing state, may be suctioned. As the first state is shifted to a second state, the pressure in the capping device may be promptly reduced to a predetermined negative pressure, as compared with a case in which the pressure in the capping device is not reduced to the negative pressure in advance. Accordingly, the time required to improve liquid ejection performance may be reduced.

A liquid ejection apparatus may include a liquid ejection head having a plurality of nozzle units, a plurality of capping devices, a movement mechanism, a plurality of suctioning tubes, a suctioning mechanism, a connection device, and a control device. Each nozzle unit may comprise one or more nozzles for ejecting liquid therefrom. Each capping device may be configured to seal a corresponding nozzle unit of the plurality of nozzle units from an external space. The movement mechanism may be configured to move each capping device relative to the liquid ejection head to place each capping device in a contact state in which the capping device is in contact with the liquid ejection head or a separate state in which the capping device is separated from the liquid ejection head. Each suctioning tube may be connected to a corresponding respective one of the plurality of capping devices. The suctioning mechanism may be configured to suction fluid in the capping device by generating a suctioning force. The connection device may be configured to connect the suctioning mechanism to each of the plurality of suctioning tubes. The control device may control the connection device and the movement mechanism to place the liquid ejection apparatus in a first state in which the suctioning mechanism is connected to a first suctioning tube, of the plurality of suctioning tubes, connected to the capping device corresponding to one of the plurality of nozzle units, to suction fluid in the capping device corresponding to the one of the plurality of nozzle units in an unsealing state in which the one of the plurality of nozzle units is not sealed from the external space, and the suctioning mechanism is connected to a second suctioning tube, of the plurality of suctioning tubes, connected to the capping device corresponding to a different one of the plurality of nozzle units, to suction fluid in the capping device corresponding to the different one of the plurality of nozzle units in a sealing state in which the different one of the plurality of nozzle units is sealed from the external space. The control device may control the suctioning mechanism to suction fluid in the capping device corresponding to the one of the plurality of nozzle units and to suction fluid in the capping device corresponding to the different one of the plurality of nozzle units in the first state. The control device may control the connection device to place the liquid ejection apparatus in a second state in which the first suctioning tube connected to the capping device corresponding to the one of the plurality of nozzle units is disconnected from the suctioning mechanism in response to expiration of a predetermined time period, the predetermined time period being a predetermined amount of time that the suctioning mechanism generates the suctioning force in the first state, wherein the second suctioning tube connected to the capping device corresponding to the different one of the plurality of nozzle units is connected to the suctioning mechanism in the second state.

A non-transitory, computer-readable storage medium storing computer-readable instructions therein that, when executed by at least one processor of a liquid ejection apparatus comprising a liquid ejection head comprising a plurality of nozzle units, each nozzle unit comprising one or more nozzles for ejecting liquid therefrom; a plurality of capping devices, each capping device configured to seal a corresponding nozzle unit of the plurality of nozzle units from an external space; a movement mechanism configured to move each capping device relative to the liquid ejection head to place each capping device in a contact state in which the capping device is in contact with the liquid ejection head or a separate state in which the capping device is separated from the liquid ejection head; a plurality of suctioning tubes, each suctioning tube connected to a corresponding respective one of the plurality of capping devices; a suctioning mechanism configured to suction fluid in the capping device by generating a suctioning force; a connection device configured to connect the suctioning mechanism to each of the plurality of suctioning tubes, instruct the liquid ejection apparatus to execute processes may be provided. The processes may comprise: controlling the connection device and the movement mechanism to place the liquid ejection apparatus in a first state in which the suctioning mechanism is connected to a first suctioning tube, of the plurality of suctioning tubes, connected to the capping device corresponding to one of the plurality of nozzle units, to suction fluid in the capping device corresponding to the one of the plurality of nozzle units in an unsealing state in which the one of the plurality of nozzle units is not sealed from the external space, and the suctioning mechanism is connected to a second suctioning tube, of the plurality of suctioning tubes, connected to the capping device corresponding to a different one of the plurality of nozzle units, to suction fluid in the capping device corresponding to the different one of the plurality of nozzle units in a sealing state in which the different one of the plurality of nozzle units is sealed from the external space; controlling the suctioning mechanism to suction fluid in the capping device corresponding to the one of the plurality of nozzle units and to suction fluid in the capping device corresponding to the different one of the plurality of nozzle units in the first state; and controlling the connection device to place the liquid ejection apparatus in a second state in which the first suctioning tube connected to the capping device corresponding to the one of the plurality of nozzle units is disconnected from the suctioning mechanism after expiration of a predetermined time period, the predetermined time period being a predetermined amount of time that the suctioning mechanism generates the suctioning force in the first state, wherein the second suctioning tube connected to the capping device corresponding to the different one of the plurality of nozzle units is connected to the suctioning mechanism in the second state.

A method of maintaining a liquid ejection apparatus comprising a liquid ejection head comprising a plurality of nozzle units, each nozzle unit comprising one or more nozzles for ejecting liquid therefrom; a plurality of capping devices, each capping device configured to seal a corresponding nozzle unit of the plurality of nozzle units from an external space; a movement mechanism configured to move each capping device relative to the liquid ejection head to place each capping device in a contact state in which the capping device is in contact with the liquid ejection head or a separate state in which the capping device is separated from the liquid ejection head; a plurality of suctioning tubes, each suctioning tube connected to a corresponding respective one of the plurality of capping devices; a suctioning mechanism configured to suction fluid in the capping device by generating a suctioning force; a connection device configured to connect the suctioning mechanism to each of the plurality of suctioning tubes, and a control device, may be provided. The method may comprise: controlling the connection device and the movement mechanism to place the liquid ejection apparatus in a first state in which the suctioning mechanism is connected to a first suctioning tube, of the plurality of suctioning tubes, connected to the capping device corresponding to one of the plurality of nozzle units, to suction fluid in the capping device corresponding to the one of the plurality of nozzle units in an unsealing state in which the one of the plurality of nozzle units is not sealed from the external space, and the suctioning mechanism is connected to a second suctioning tube, of the plurality of suctioning tubes, connected to the capping device corresponding to a different one of the plurality of nozzle units, to suction fluid in the capping device corresponding to the different one of the plurality of nozzle units in a sealing state in which the different one of the plurality of nozzle units is sealed from the external space; controlling the suctioning mechanism to suction fluid in the capping device corresponding to the one of the plurality of nozzle units and to suction fluid in the capping device corresponding to the different one of the plurality of nozzle units in the first state; and controlling the connection device to place the liquid ejection apparatus in a second state in which the first suctioning tube connected to the capping device corresponding to the one of the plurality of nozzle units is disconnected from the suctioning mechanism after expiration of a predetermined time period, the predetermined time period being a predetermined amount of time that the suctioning mechanism generates the suctioning force in the first state, wherein the second suctioning tube connected to the capping device corresponding to the different one of the plurality of nozzle units is connected to the suctioning mechanism in the second state Other objects, features, and advantages will be apparent to persons of ordinary skill in the art from the following detailed description of the invention and the accompanying drawings.

BRIEF DESCRIPTION OF THE DRAWINGS

Reference now is made to the following description taken in connection with the accompanying drawings.

FIG. 9 is a timing chart depicting operations of the maintenance unit of FIG. 2.

DETAILED DESCRIPTION

Figure 1A:
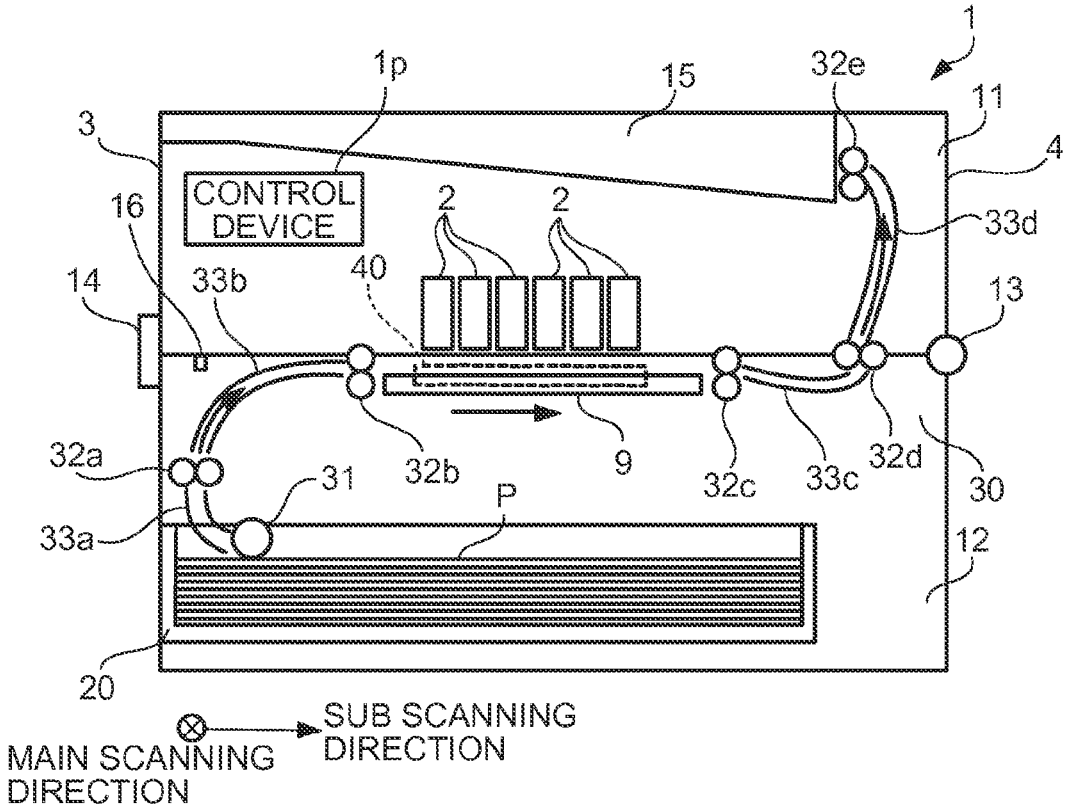
FIG. 1A is a schematic side sectional view of an inkjet printer according to one or more aspects of the disclosure.

Example embodiments are described in detail herein with reference to the accompanying drawings, like reference numerals being used for like corresponding parts in the various drawings.

As depicted in FIG. 1A, an inkjet printer 1 may comprise an upper casing 11 and a lower casing 12. Each of the upper casing 11 and the lower casing 12 may have a rectangular parallelepiped shape. A front side 3 and a rear side 4 of the printer 1 may be disposed on the left and right sides in FIG. 1A, respectively. A lower surface of the upper casing 11 may have an opening. An upper surface of the lower casing 12 may have an opening. The upper casing 11 may be pivotally connected to the lower casing 12 about a pivot shaft 13. The upper casing 11 may pivotally move between a closed position in which an interior space of the printer 1 is defined by making a lower surface of the upper casing 11 contact to an upper surface of the lower casing 12 and an open position in which the interior space of the printer 1 is open. An opening/closing sensor 16 may be fixed on the upper surface of the lower casing 11. The opening/closing sensor 16 may be configured to output a detection signal when the upper casing 11 is in the closed position and not to output the detection signal when the upper casing 11 is in the open position. The printer 1 may comprise a lock mechanism 14 configured to regulate the pivotal movement of the upper casing 11 when the upper casing 11 is in the closed position. A sheet output portion 15 may be disposed on an upper surface of the upper casing 11. A sheet P for which printing has been completed may be sequentially output onto the sheet output portion 15.

Six inkjet heads 2, a sheet tray 20, a sheet feeding mechanism 30, a platen 9, and a maintenance unit 40 may be disposed in the interior space of the printer 1.

Figure 1B:
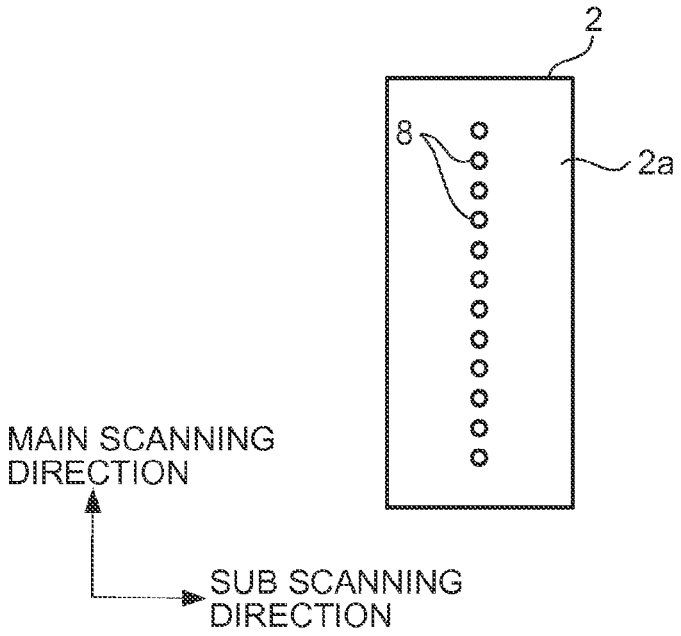
FIG. 1B is a plane view of a nozzle surface of an inkjet head of the inkjet printer.

As depicted in FIG. 1B, each inkjet head 2 may have generally a rectangular parallelepiped shape. The inkjet head 2 may have an ejection surface 2*a* on a lower surface thereof. The ejection surface 2*a* may have nozzles 8 from which ink droplets may be ejected. Ink may be supplied from an ink tank (not depicted) to the inkjet head 2. Ink supplied to the inkjet head 2 may reach the nozzles 8, via a common ink chamber and pressure chambers that may fluidly communicate with the common ink chamber. Actuators (not depicted) configured to apply pressure to ink stored in the pressure chambers may be disposed in an interior of the inkjet head 2. As the actuators are driven, ink droplets may be ejected from the nozzles 8.

Each of the six inkjet heads 2 may correspond to one of different ink types, e.g., colors, of e.g., yellow, light cyan, light magenta, cyan, magenta and black. The inkjet heads 2 corresponding to yellow, light cyan, light magenta, cyan, magenta and black ink colors may be arranged in this order from an upstream side in a feeding direction of the sheets P. In the example embodiment, each inkjet head 2 may correspond to one of different ink type. In another embodiment, a plurality of the inkjet heads 2 may correspond to one ink type, or one inkjet head 2 may correspond to a plurality of ink types.

The sheet tray 20 may be configured to hold a stack of the sheets P. The sheet tray 20 may be removably disposed on a bottom surface of the lower casing 12.

The platen 9 may comprise a plate member configured to support the sheets P. The platen 9 may be fixed to the lower casing 12 to oppose the ejection surfaces 2*a* of the inkjet heads 2 when the upper casing 11 is in the closed position. Sizes of the platen 9 in a main scanning direction and a sub scanning direction may be slightly larger than the sizes of the ejection surfaces 2*a* of the six inkjet heads 2.

The sheet feeding mechanism 30 may comprise a feeding path for the sheets P from the sheet tray 20 to the sheet output portion 15 through a portion between the six inkjet heads 2 and the platen 9. The sheet feeding mechanism 30 may further comprise a pickup roller 31, nip rollers 32*a*-32*e*, and guides 33*a*-33*d*. The pickup roller 31 may be configured to pick up and feed an uppermost sheet P from a stack of the sheets P on the sheet tray 20. The nip rollers 32*a*-32*e* may be disposed along the feeding path. The nip rollers 32*a*-32*e* may apply feeding force to the sheet P. The guide 33*a* may be disposed between the pickup roller 31 and the nip roller 32*a* in the feeding path. The guide 33*a* may be configured to guide the sheet P until the sheet P having feeding force applied thereto by the pickup roller 31 is fed to the next nip rollers 32*a*. Similarly, the guide 33*b*, 33*c*, and 33*d* may be disposed between the nip rollers 32*a* and 32*b*, 32*c* and 32*d*, and 32*d* and 32*e* in the feeding path, respectively. The guides 33*b*-33*d* may be configured to guide the sheet P until the sheet P having feeding force applied thereto by the nip roller 32*a*, 32*c*, and 32*d* is fed to the next nip roller 32*b*, 32*d*, and 32*e*. When the sheet P fed by the sheet feeding mechanism 30 passes between the six inkjet heads 2 and the platen 9, an image may be printed on the sheet P by the ink droplets ejected from the ejection surface 2*a* having the nozzles 8 of each inkjet head 2. The sheet P having an image printed thereon may be fed by the sheet feeding mechanism 30 in the feeding direction and output to the sheet output portion 15.

Figure 2:
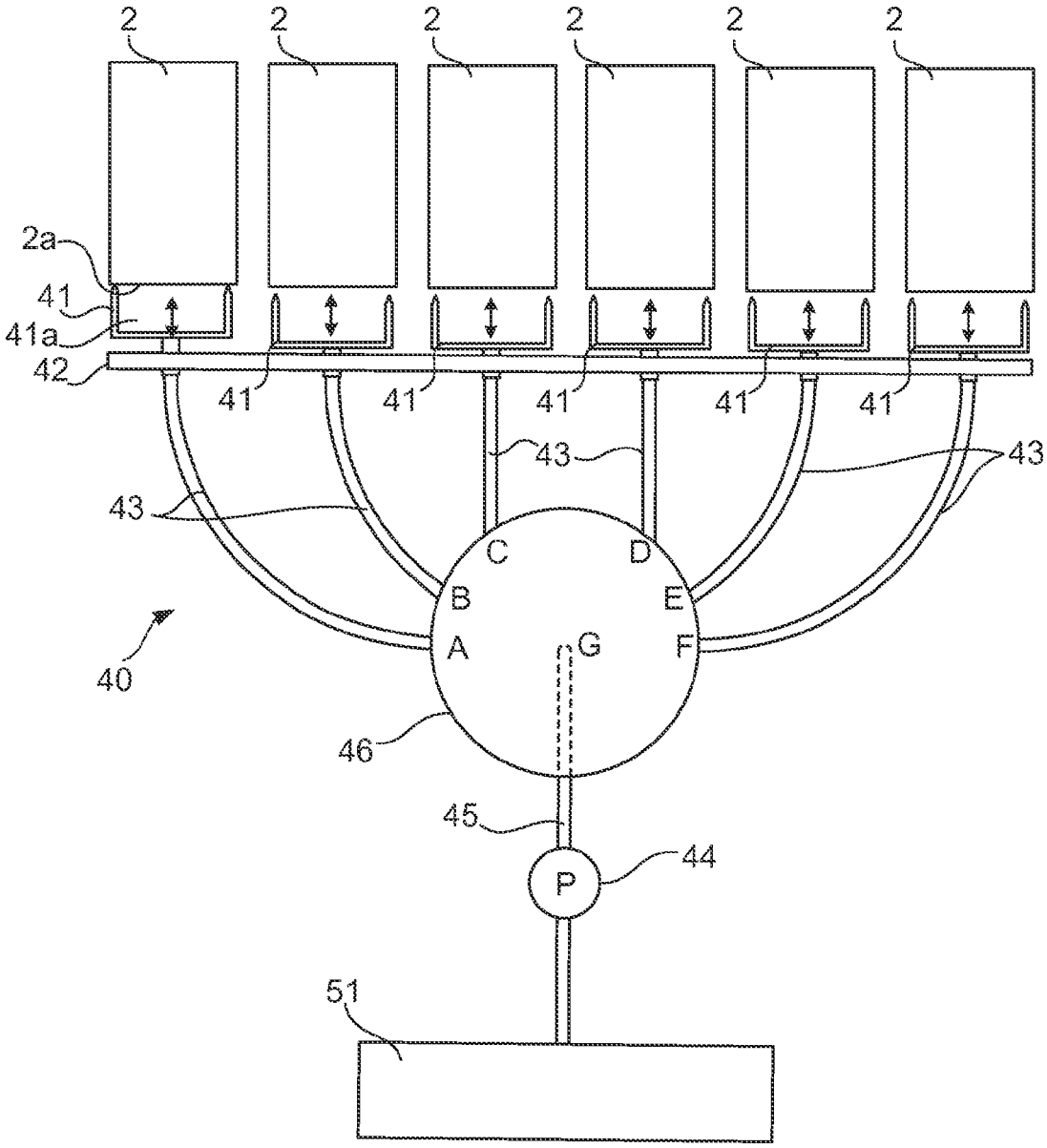
FIG. 2 is a diagram depicting a maintenance unit of the inkjet printer of FIG. 1A.

As depicted in FIGS. 1A and 2, the maintenance unit 40 may be configured to perform a maintenance operation to recover, e.g., clogging of the nozzles 8 of the inkjet heads 2. The maintenance operation may comprise a purge operation in which ink may be forcibly discharged from the nozzles 8. The maintenance unit 40 may comprise six cap members 41, an elevation mechanism 42, six suction tubes 43, a pump 44, a waste liquid tube 45, a rotary valve 46, and a waste liquid tank 51.

Each of the six cap members 41 may comprise an elastic member configured to seal the nozzles 8 of the corresponding inkjet head 2 from an external space, e.g., the atmosphere. Each cap member 41 may comprise a recess portion 41*a* having an open end facing upward so as to allow the ejection surface 2*a* to be surrounded. Each cap member 41 may have an annular shape. When an upper end of the recess portion 41*a* contacts the ejection surface 2*a*, the recess portion 41*a* may be placed in a sealing state in which all nozzles 8 of the corresponding inkjet head 2 may be sealed from the external space (refer to the leftmost cap member 41 in FIG. 2). When the upper end of the recess portion 41*a* is separated from the ejection surface 2*a*, the recess portion 41*a* may be placed in an unsealing state, e.g., an open state, in which the nozzles 8 may be open to the external space (refer to the cap members 41 other than the leftmost cap member 41 in FIG. 2).

The elevation mechanism 42 may support the six cap members 41 that may be arranged in one direction. The elevation mechanism 42 may be configured to move each of the six cap members 41 up and down relative to the respective ejection surfaces 2*a*, such that the cap members 41 may be independently placed in the sealing state or the open state. When the printer 1 is on standby for printing, the elevation mechanism 42 may move behind the platen 9, e.g., backward with respect to the sheet of FIG. 1A, so as not to oppose the ejection surface 2*a*. When the maintenance operation is performed, the elevation mechanism 42 may be moved by a movement mechanism (not depicted) to a maintenance position in which the cap members 41 oppose the corresponding the ejection surfaces 2*a*. The maintenance operation may comprise a sealing operation to prevent or reduce drying of the nozzles 8 by sealing the ejection surfaces 2*a* with the cap members 41, in addition to the purge operation. The elevation mechanism 42 may be configured to move each one of cap members 41 up and down relative to the respective ejection surfaces 2*a*. In addition, the elevation mechanism 42 may be configured to move two or more cap members 41 simultaneously up and down relative to the respective ejection surfaces 2*a*.

The pump 44 may be configured to suction fluid, e.g., air or ink, in the recess portions 41*a* of the cap members 41. The pump 44 may be configured to generate suction force. The rotary valve 46 may be configured to bring one or two cap members 41 among the six cap members 41 into communication with the pump 44. The waste liquid tank 51 may be configured to store waste ink discharged from the nozzles 8 of the inkjet heads 2. The purge operation in which a relatively large amount of ink is forcibly discharged from the nozzles 8 and a flushing operation in which ink droplets are ejected from the nozzles 8 may generate the waste ink. Each of the six suction tubes 43 may be connected to the corresponding one of the recess portions 41*a* of the cap members 41 at one end and to the rotary valve 46 at the other end. The waste liquid tube 45 may be connected to the rotary valve 46 at one end and to the waste liquid tank 51 at the other end. The waste liquid tube 45 may be connected to the pump 44.

Figure 3:
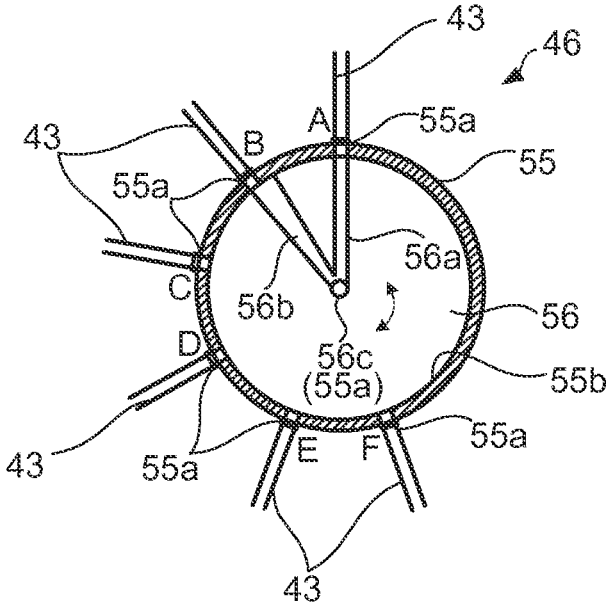
FIG. 3 is a sectional view of a rotary valve of the maintenance unit of FIG. 2, according to an exemplary embodiment.

As depicted in FIGS. 2 and 3, the rotary valve 46 may comprise a rotation shaft, a casing 55 having a hollow cylindrical shape and a rotation member 56 disposed in an internal space 55*b* of the casing 55. The rotation member 56 may have a cylindrical shape. The rotation member 56 may be configured to rotate inside the internal space 55*b* along a circumferential direction of the casing 55. The casing 55 may have seven communication openings 55*a* through which the internal space 55*b* may be brought into communication with the external space. Among the seven communication openings 55*a*, one of the six communication openings 55*a* disposed on an outer peripheral surface of the casing 55 along the circumferential direction may correspond to different one of ports A-F. The communication opening 55*a* formed at a central portion of an end face of the casing 55 may correspond to a port G. The suction tubes 43 may be connected to the ports A-F. The waste liquid tube 45 may be connected to the port G.

The rotation member 56 may have a first flow path 56*a* and a second flow path 56*b* that extend from the outer peripheral surface of the casing 55 to the rotation shaft along a radial direction of the casing 55, and a third flow path 56*c* that extends along the rotation shaft and brings the first and second flow paths 56*a* and 56*b* into communication with the port G. The second flow path 56*b* may become wider in the circumferential direction of the casing 55, as the second flow path 56*b* extends closer to the outer peripheral surface of the casing 55. Accordingly, a cross-sectional area of the passage of the first flow path 56*a* may be smaller than that of the passage of the second flow path 56*b*. Among the ports A-F, the first and second flow paths 56*a*, 56*b* may sequentially communicate with one of the adjacent two ports A-F, both of the adjacent two ports A-F, and the other one of the two adjacent ports A-F, as the rotation member 56 rotates in one direction. For example, the second flow path 56 may be connected to one of the adjacent two ports A-F. Then, each of the first and second flow paths 56*a* may be connected to different one of the adjacent two ports A-F. Then, the second flow path 56 may be connected to the other one of the adjacent two ports A-F. As will be described below, when the first flow path 56*a* is connected to one of the ports A-F, the recess portion 41*a* corresponding to the one of the ports A-F may be placed in the open state. When the second flow path 56*b* is connected to one of the ports A-F, the recess portion 41*a* corresponding to that the one of the ports A-F may be placed in the sealing state. At this time, the one or two recess portion(s) 41*a* corresponding to the one or two port(s) A-F connected to the first flow path 56*a* and/or the second flow path 56*b* may be connected to the port G (i.e., the pump 44). A motor (not depicted) may control the rotational position of the rotation member 56.

Figure 4:
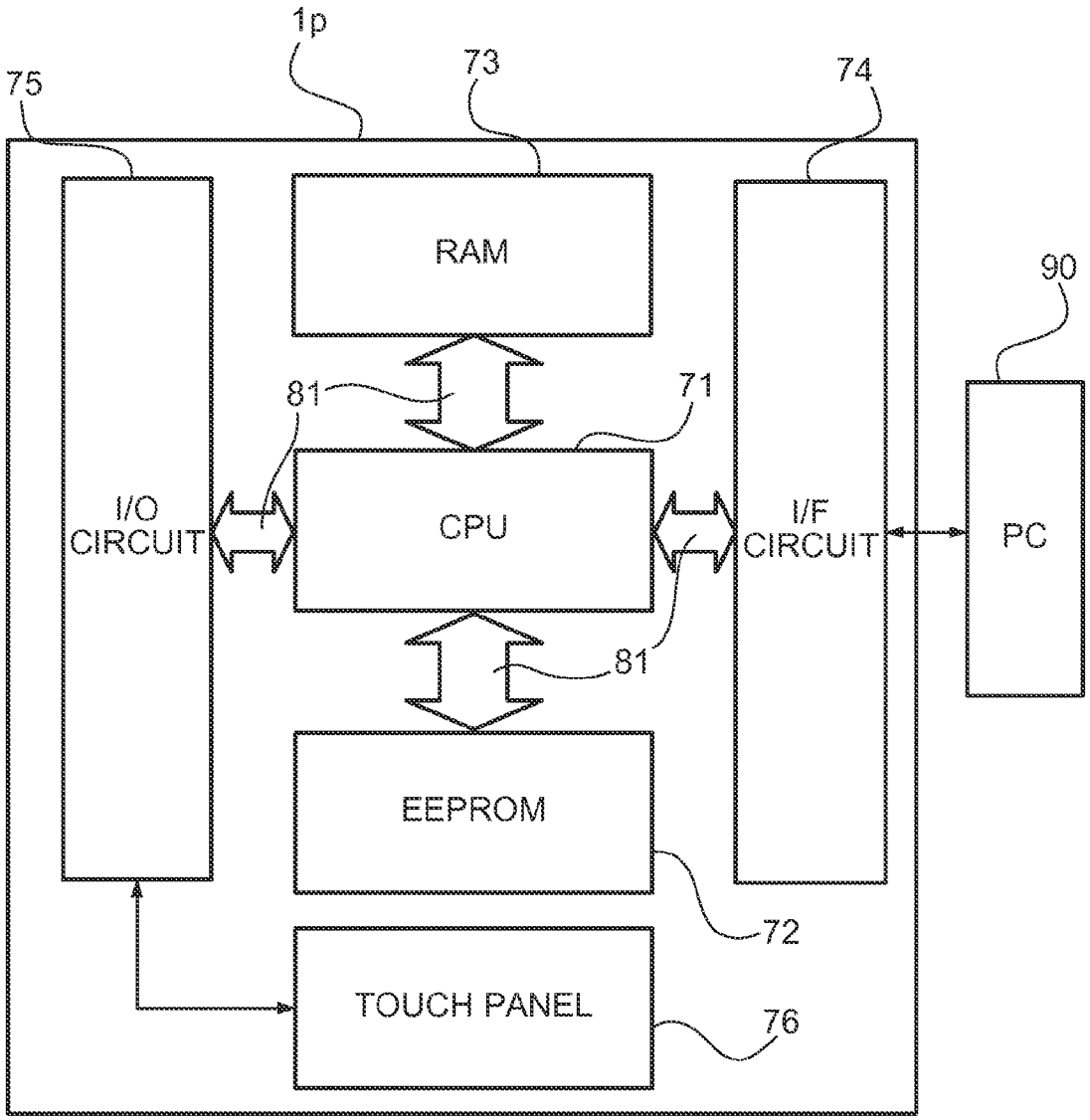
FIG. 4 is a block diagram depicting a hardware configuration of a control device of the inkjet printer of FIG. 1A.

As depicted in FIG. 4, the control device 1*p* may comprise a central processing unit (CPU) 71, an electrically erasable and programmable read only memory (EEPROM) 72 configured to rewritably store programs, e.g., computer-readable instructions, to be executed by the CPU 71 and data to be used by the programs, a random access memory (RAM) 73 configured to temporarily store data when programs are executed, an I/F circuit 74 configured to perform communication with an external device, e.g., a PC 90, and an I/O circuit 75 connected to a touch panel 76 and various sensors (not depicted). The CPU 71, the EEPROM 72, the RAM 73, the I/F circuit 74 and the I/O circuit 75 may be interconnected via data buses 81. A print controller 61, a maintenance controller 62, and a display controller 63, as depicted in FIG. 5, of the control device 1*p* may be constructed in cooperation with the hardware 71-75 and software, e.g., computer-readable instructions, stored in the EEPROM 72.

Figure 5:
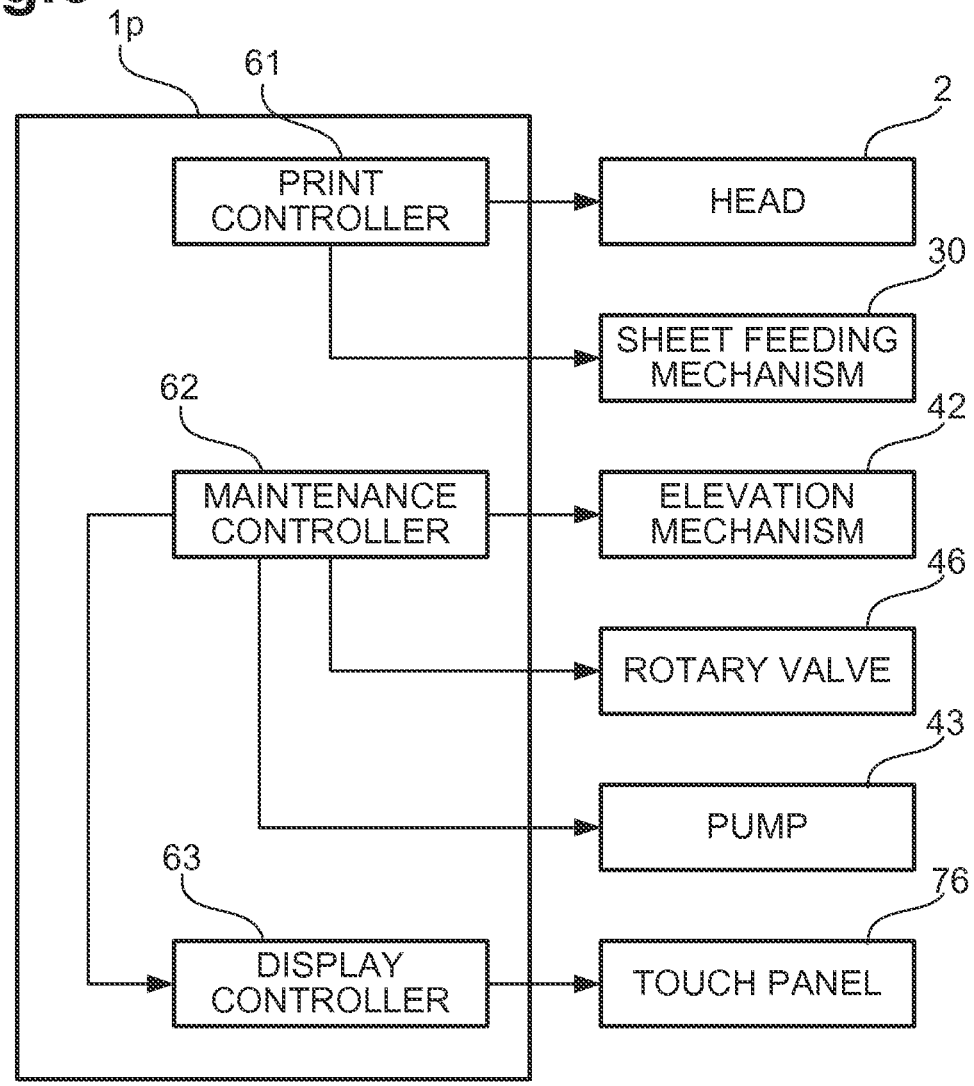
FIG. 5 is a block diagram depicting components of the inkjet printer of FIG. 1A.

As depicted in FIG. 5, the control device 1*p* may comprise the print controller 61, the maintenance controller 62, and the display controller 63. The print controller 71 may be configured to control the inkjet heads 2 and the sheet feeding mechanism 30 such that a desired image is printed on the sheet P. The display controller 63 may be configured to control the touch panel 76. The maintenance controller 62 may be configured to control the elevation mechanism 42, the rotary valve 46 and the pump 44 such that the maintenance operation including the purge operation is executed. The purge operation may comprise a suctioning operation, an idle suctioning operation, and a preliminary suctioning operation. In a suctioning operation, fluid in the recess portion 41*a* of one cap member 41 that is placed in the sealing state may be suctioned. In the idle suctioning operation, fluid in the recess portion 41*a* of the one cap member 41 that is placed in the open state may be suctioned. In the preliminary suctioning operation, at the same time when the idle suctioning operation is performed for the one cap member 41, fluid in the recess portion 41*a* of the another cap members 41 that is placed in the sealing state may be suctioned.

Figure 6:
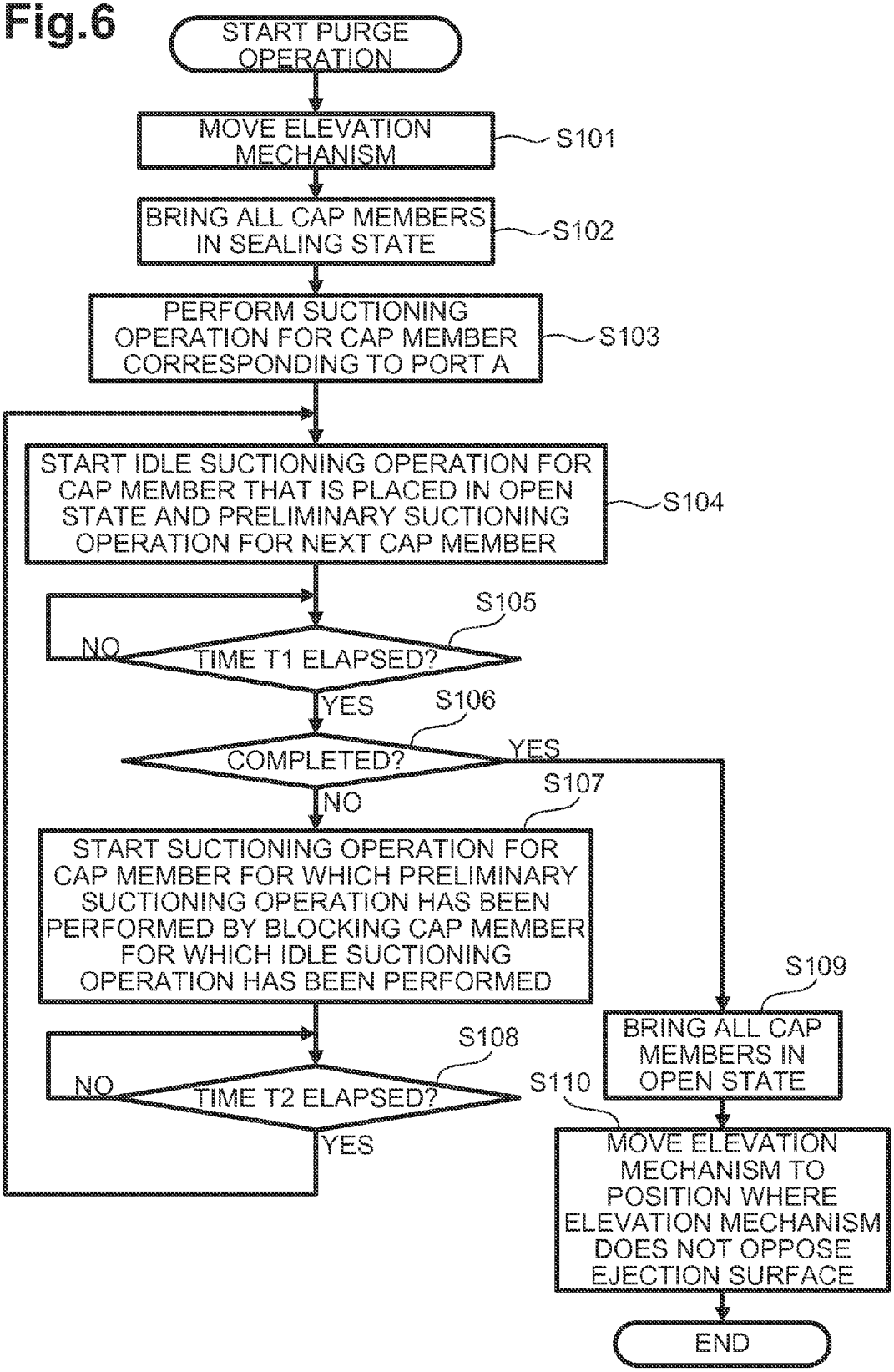
FIG. 6 is a flowchart depicting a maintenance operation for the inkjet printer of FIG. 1A.
Figure 7A:
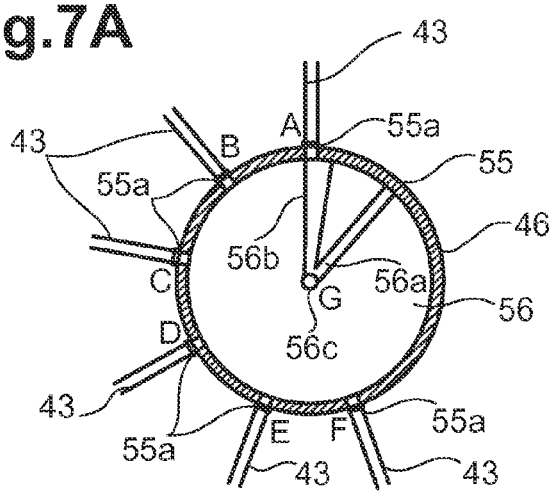
FIGS. 7A-7C are diagrams and tables depicting operations of the maintenance unit of FIG. 2.

As depicted in FIG. 6, when the purge operation is started, the maintenance controller 62 may move the elevation mechanism 42 such that each of the recess portions 41*a* of the cap members 41 may oppose the corresponding ejection surface 2*a* of the inkjet head 2 (S101). The maintenance controller 62 may control the elevation mechanism 42 to bring all cap members 41 in the sealing state (S102). Thus, the nozzles 8 may be sealed to prevent or reduce the drying of the nozzles 8. The maintenance controller 62 may rotate the rotation member 56 to connect the port A and the second flow path 56*b*, as depicted in FIG. 7A, to perform the suctioning operation for the inkjet head 2 corresponding to the port A. Accordingly, the recess portion 41*a* of the cap member 41, that is placed in the sealing state, corresponding to the port A may communicate with the pump 44. In this state, as the pump 44 is driven for a predetermined time, the suctioning operation may be executed. Accordingly, ink may be purged into the recess portion 41*a* corresponding to the port A from the nozzles 8 of the inkjet head 2 that is sealed by the recess portion 41*a* corresponding to the port A (S103).

Figure 7B:
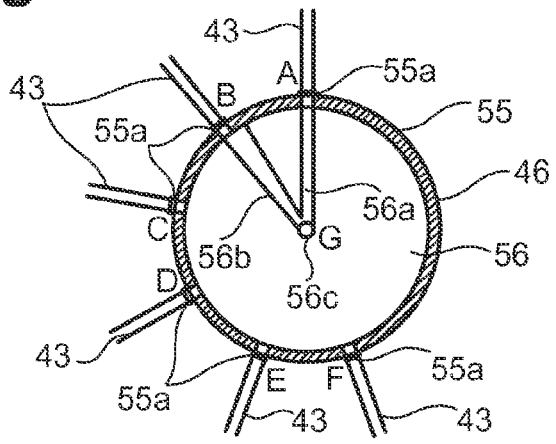

The maintenance controller 62 may simultaneously perform the idle suctioning operation for one inkjet head 2 and the preliminary suctioning operation for another inkjet head 2. More specifically, the idle suctioning may be performed by placing the cap member 41 corresponding to the inkjet head 2 for which the suctioning operation has been just performed, in the open state. With the cap member 41 in the open state, ink stored in recess portion 41*a* during the suctioning operation may be suctioned during the idle suctioning operation. At the same time when the idle suctioning operation is performed, the preliminary suctioning operation may be performed, prior to the suctioning operation, for another inkjet head 2 for which the suctioning operation is to be performed next, by placing the cap member 41 corresponding to another inkjet head 2 in the sealing state (S104). For example, the maintenance controller 62 may control the elevation mechanism 42 to bring the cap member 41 corresponding to the port A to the open state from the sealing state, and to maintain the cap members 41 corresponding to the port B in the sealing state (a first sealing state). Further, the maintenance controller 62 may rotate the rotation member 56 counterclockwise to connect the ports A and B to the first flow path 56*a* and the second flow path 56*b*, respectively (the first state), as depicted in FIG. 7B. Accordingly, the two recess portions 41*a* of the cap members 41 corresponding to the ports A and B may communicate with the pump 44 that is being driven. Accordingly, the idle suctioning operation may be performed for the recess portion 41*a* of the cap member 41, that is placed in the open state, corresponding to the port A. The preliminary suctioning operation may be performed for the recess portion 41*a* of the cap member 41, that is placed in the sealing state, corresponding to the port B.

The maintenance controller 62 may wait until the elapsed time since the idle suctioning operation has been started becomes equal to time t1 (S105: NO). The time t1 may be the time for which the idle suctioning operation may be continued. More specifically, the time t1 may be longer than or equal to the time required to suction all of the maximum amount of ink that the recess portion 41*a* of the cap member 41 to be subjected to the idle suctioning operation is able to store therein. Accordingly, ink remaining in the recess portion 41*a* may be reliably discharged. As depicted in FIG. 9, while the idle suctioning operation is performed to suction ink remaining in the recess portion 41*a* corresponding to the port A, internal pressures of the recess portions 41*a* corresponding to the ports A and B may be reduced. Thereafter, as the ink remaining in the recess portion 41*a* corresponding to the port A is all suctioned, the port A may communicate with the atmosphere, so that the internal pressures of the recess portions 41*a* corresponding to the ports A and B may increase. However, the pump 44 may continue to suction fluid, e.g., the air, so that a certain negative pressure may be maintained.

When the maintenance controller 62 determines that the elapsed time becomes equal to the time t1 (S105: YES), the maintenance controller 62 may determine whether the idle suctioning operation is completed for all of the inkjet heads 2 (S106). When the maintenance controller 62 determines that the idle suctioning operation is completed for all of the inkjet heads 2 (S106: YES), the maintenance controller 62 may place all cap members 41 in the open state (S109). Thereafter, the maintenance controller 62 may move the elevation mechanism 42 to a position where the elevation mechanism 42 does not oppose the ejection surface surfaces 2*a* (S110). Then, the purge operation may end.

Figure 7C:
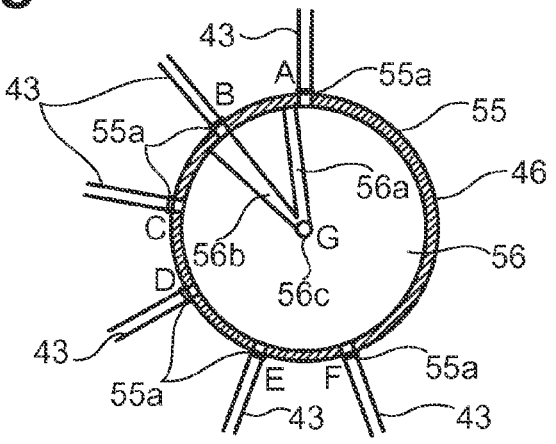

When the maintenance controller 62 determines that the idle suctioning operation is not completed for all of the inkjet heads 2 (S106: NO), the maintenance controller 62 may continue the purge operation for the next inkjet head 2 (S107). The maintenance controller 62 may control the elevation mechanism 42 to bring the cap member 41 corresponding to the port A to the sealing state from the open state and to maintain the cap members 41 corresponding to the port B in the sealing state. As depicted in FIG. 7C, the maintenance controller 62 may rotate the rotation member 56 counterclockwise to maintain the connection between the port B and the second flow path 56*b* while the port A is blocked (the second state). Accordingly, the recess portion 41*a* of the cap member 41, that is placed in the sealing state, corresponding to the port B may communicate with the pump 44 that is being driven. The suctioning operation may be started to purge ink from the nozzles 8 of the inkjet head 2 sealed by the recess portion 41*a*. At this time, pressure in the recess portion 41*a* corresponding to the port B may be maintained in the negative pressure by the preliminary suctioning operation that may be preliminary performed before the suctioning operation, as depicted in FIG. 9. Therefore, the pressure in the recess portion 41*a* corresponding to the port B may be promptly reduced to the desired negative pressure with the reduced time, as compared with a case in which the preliminary suctioning operation is not performed (refer to broken lines in FIG. 9). Accordingly, ink may be effectively purged from the nozzles 8 of the inkjet head 2 sealed by the recess portion 41*a* corresponding to the port B. Then, the maintenance controller 62 may wait until the elapsed time since the suctioning operation has been started becomes equal to time t2 (S108: NO). The time t2 may correspond to the time in which the ink ejection performance of the nozzles 8 of the inkjet head 2 may be recovered by the purge operation.

Figure 8A:
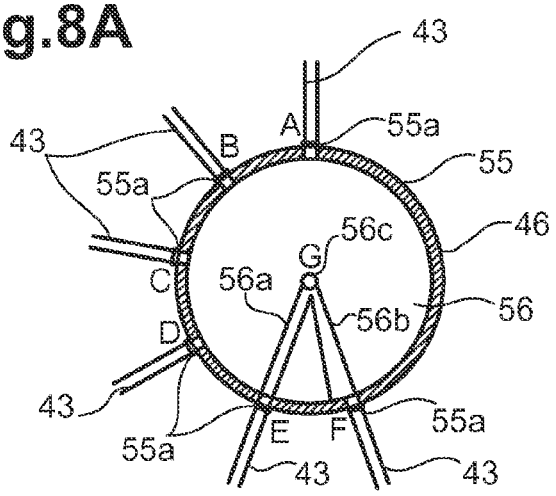
FIGS. 8A-8C are diagrams and tables depicting operations of the maintenance unit of FIG. 2.
Figure 8B:
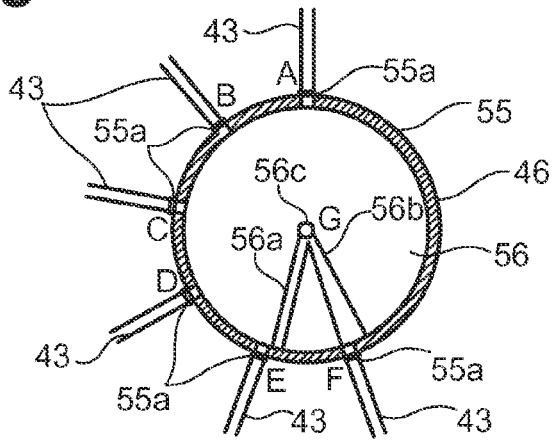
Figure 8C:
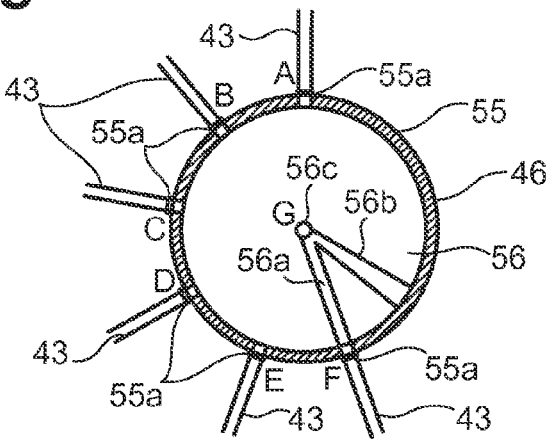

When the maintenance controller 62 determines that the elapsed time becomes equal to the time t2 (S108: YES), the idle suctioning operation may performed for the recess portion 41*a* for which the suctioning operation has been just performed, in the procedure as described above. At the same time, the preliminary suctioning operation may be performed for the recess portion 41*a* corresponding to the next inkjet head 2, if any. The above-described steps S104-S108 may be repeated for the ports B and C, the ports C and D, the ports D and E, and the ports E and F (refer to FIGS. 8A and 8B) to sequentially perform the preliminary suctioning operation, the suctioning operation and the idle suctioning operation for the inkjet heads 2 corresponding to the ports C-F. As depicted in FIG. 8C, for the inkjet head 2 corresponding to the port F, the idle suctioning operation may be performed independently without the preliminary suctioning operation being performed at the same time (S104). In the example embodiment, when the idle suctioning operation for the inkjet head 2 corresponding to the port F is completed, the maintenance controller 62 may determine that the idle suctioning operation is completed for all of the inkjet heads 2 (S106: YES), the maintenance controller 62 may place all cap members 41 in the open state (S109), and then move the elevation mechanism 42 to a position where the elevation mechanism 42 does not oppose the ejection surfaces 2. Then, the purge operation may end (S110).

The printer 1 according to the example embodiment may perform suctioning in the first state, so that the preliminary suctioning operation may be performed to bring the pressure in the recess portion 41*a* of the cap member 41, which is to be subjected to the suctioning operation, to negative pressure, at the same time as the idle suctioning operation. As the preliminary suctioning operation is shifted to the suctioning operation, the pressure in the recess portion 41*a* may be promptly reduced to the predetermined negative pressure, as compared with a case in which the recess portion 41*a* is not reduced to negative pressure in advance before the suctioning operation is performed. Accordingly, ink may be effectively purged, and the time required to recover ink ejection performances may be reduced.

The time t1 for which the idle suctioning operation may be continued may be the time longer than or equal to the time required to suction all of the maximum amount of ink that the recess portion 41*a* of the cap member 41 to be subjected to the idle suctioning operation is able to store therein. Therefore, ink remaining in the recess portion 41*a* may be reliably discharged from the recess portion 41*a*.

Further, with the use of the rotary valve 46, connections between the six suction tubes 43 and the waste liquid tube 45 may be readily arranged and reduction of the size of the printer 1 may be achieved.

In the rotation member 56 of the rotary valve 46, a cross-sectional area of the passage of the first flow path 56*a* may be smaller than that of the passage of the second flow path 56*b*. Therefore, in the preliminary suctioning operation, the pressure in the recess portion 41*a* that communicates with the second flow path 56*b* may be effectively brought to negative pressure.

The cap members 41, other than one cap member 41 for which the idle suctioning operation is being performed, may be placed in the sealing state. Therefore, drying of the nozzles 8 may be prevented or reduced.

A difference of the second example embodiment from the first example embodiment may be a rotary valve 146. Structures and operations of the rotary valve 146 are described below referring to FIGS. 10A-11C. Like reference numerals may be used for like corresponding components in FIGS. 10A-11C and a detailed description thereof with respect to the second example embodiment may be omitted herein.

The rotary valve 146 may comprise the rotation shaft, the casing 55 having a hollow cylindrical shape and the rotation member 56 disposed in the internal space 55*b* of the casing 55. The rotation member 56 may have a cylindrical shape. The rotation member 56 may be configured to rotate inside the internal space 55*b* along the circumferential direction of the casing 55. The casing 55 may have seven communication openings 55*a* through which the internal space 55*b* may be brought into communication with an external space, e.g., the atmosphere. Among the seven communication openings 55*a*, one of the six communication openings 55*a* disposed equiangularly at the central angle of 60 degrees on an outer peripheral surface of the casing 55 along the circumferential direction may correspond to the different one of the ports A-F. The communication opening 55*a* formed at a central portion of an end face of the casing 55 may correspond to the port G. The suction tubes 43 may be connected to the ports A-F. The waste liquid tube 45 may be connected to the port G.

The rotation member 56 may have six communication paths 156*aa*, 156*ab*, 156*ba*, 156*bb*, 156*ca*, and 156*cb* that extend from the outer peripheral surface of the casing 55 to the rotation shaft along the radial direction of the casing 55, and a communication path 156*d* that extends along the rotation shaft and brings the communication paths 156*aa*, 156*ab*, 156*ba*, 156*bb*, 156*ca*, and 156*cb* into communication with the port G. The communication paths 156*aa* and 156*ab*, the communication paths 156*ba* and 156*bb*, and the communication paths 156*ca* and 156*cb* may be paired. The communication paths 156*aa* and 156*ab* may be separated apart by the central angle of 60 degrees with respect to the circumferential direction. The communication paths 156*ba* and 156*bb* may be separated apart by the central angle of 120 degrees with respect to the circumferential direction. The communication path 156*ca* and 156*cb* may be separated apart by the central angle of 180 degrees with respect to the circumferential direction. As each communication path 156*aa*, 156*ab*, 156*ba*, 156*bb*, 156*ca*, and 156*cb* extends closer to the outer peripheral surface of the casing 55, each of the communication paths 156*aa*-156*cb* may become wider in the circumferential direction so as to expand toward a side away from the other one of the communication paths 156*aa*-156*cb* in one pair 156*aa* and 156*ab*; 156*ba* and 156*bb*; and 156*ca* and 156*cb*. One pair of the communication paths 156*aa* and 156*ab*; 156*ba* and 156*bb*; and 156*ca* and 156*cb* may be separated apart from the other pairs of the communication paths 156*aa* and 156*ab*; 156*ba* and 156*bb*; and 156*ca* and 156*cb*, at a central angle other than 60 degrees with respect to the circumferential direction.

Among the ports A-F, the communication paths 156*aa* and 156*ab*; 156*ba* and 156*bb*; 156*ca* and 156*cb* may sequentially communicate with one of the arbitrarily selected two ports A-F, both of the arbitrarily selected two ports A-F, and the other one of the arbitrarily selected two ports A-F, as the rotation member 56 rotates in one direction. For example, one of one pair of the communication paths 156*aa* and 156*ab*; 156*ba* and 156*bb*; 156*ca* and 156*cb* may communicate with one of the arbitrarily selected two ports A-F. Then, each of the one pair of the communication paths 156*aa* and 156*ab*; 156*ba* and 156*bb*; 156*ca* and 156*cb* may communicate with different one of the arbitrarily selected two ports A-F. Then, the other one of the one pair of the communication paths 156*aa* and 156*ab*; 156*ba* and 156*bb*; 156*ca* and 156*cb* may communicate with the other one of the arbitrarily selected two ports A-F. The ports A-F may be equiangularly disposed at the central angle of 60 degrees. Therefore, any of the two selected ports A-F may be separated apart at any one of the central angle of 60 degrees, 120 degrees, and 180 degrees. Any pair of the communication paths 156*aa* and 156*ab*; 156*ba* and 156*bb*, 156*ca* and 156*cb* may be used for connection to one or two ports A-F. One pair of the communication paths 156*aa* and 156*ab*; 156*ba* and 156*bb*; and 156*ca* and 156*cb* may be separated apart from the other pairs of the communication paths 156*aa* and 156*ab*; 156*ba* and 156*bb*; and 156*ca* and 156*cb*, at a central angle other than 60 degrees with respect to the circumferential direction. Therefore, the other pairs of the communication paths 156*aa* and 156*ab*; 156*ba* and 156*bb*, 156*ca* and 156*cb* might not be connected to the other ports A-F.

Figure 10A:
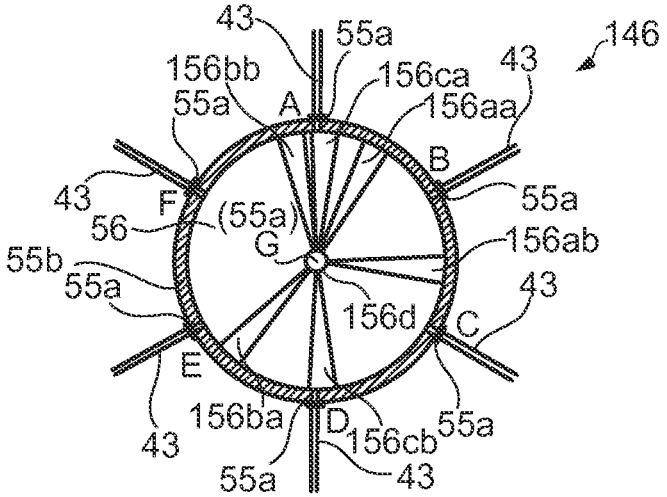
FIGS. 10A and 10B are sectional views of a rotary valve according to an exemplary embodiment.
Figure 10B:
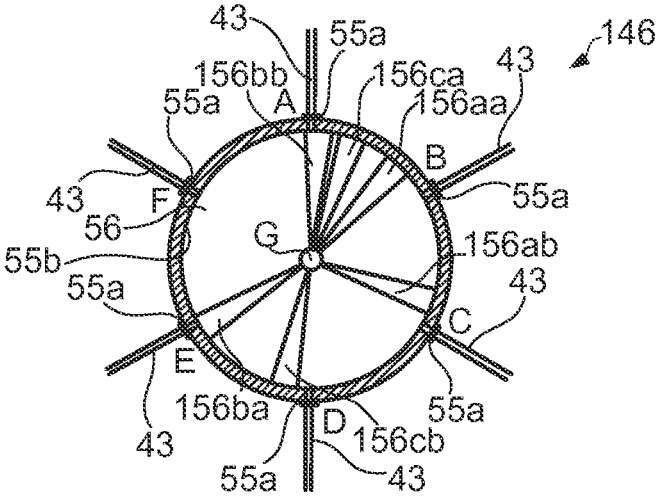
Figure 11A:
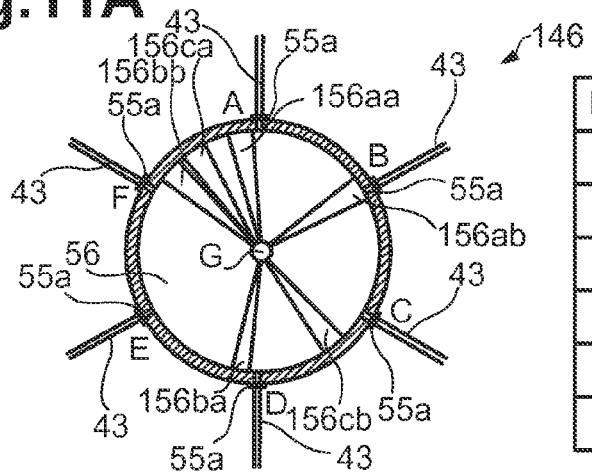
FIGS. 11A-11C are diagrams and tables depicting operations of the rotary valve of FIGS. 10A and 10B.
Figure 11B:
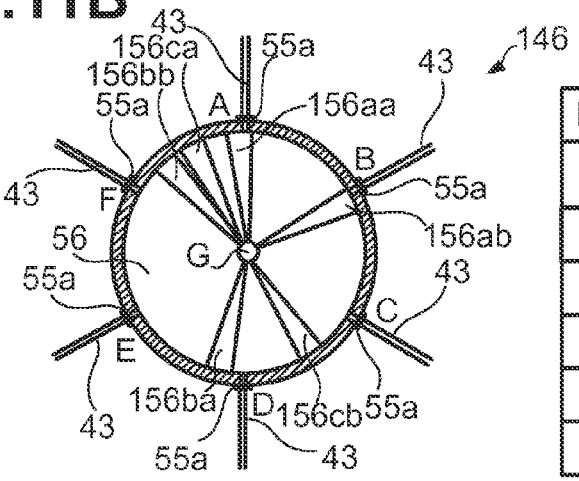

For example, as depicted in FIG. 10A, when the ports A and D, which are separated apart at the central angle of 180 degrees, are brought into communication with the pump 44, a pair of the communication paths 156*ca* and 156*cb* separated apart at the central angle of 180 degrees may be connected to the ports A and D. In FIG. 10A, the communication path 156*ca* may be connected to the port A and the communication path 156*cb* may be connected to the port D. As depicted in FIG. 10B, when the ports A and E, which are separated apart at the central angle of 120 degrees, are brought into communication with the pump 44, a pair of the communication paths 156*ba* and 156*bb* separated apart at the central angle of 120 degrees may be connected to the ports A and E. In FIG. 10B, the communication path 156*bb* may be connected to the port A, and the communication path 156*ba* may be connected to the port E. Further, when the ports A and B, which are separated apart at the central angle of 60 degrees, are brought into communication with the pump 44, a pair of the communication paths 156*aa* and 156*ab* separated apart at the central angle of 60 degrees may be connected to the ports A and B. In FIG. 11B, the communication path 156*aa* may be connected to the port A, and the communication path 156*ab* may be connected to the port B.

In the example embodiment, the purge operation may be performed for every two inkjet heads 2 that are arbitrarily selected. For example, when the two inkjet heads 2 that are selected for the purge operation correspond to the ports A and B, the maintenance controller 62 may control the elevation mechanism 42 to bring the cap member 41 corresponding to the port B in the sealing state. As the maintenance controller 62 rotates the rotation member 56 to bring the port B into communication with the pump 44 and to block other ports A and C-F, as depicted in FIG. 11A, the communication path 156*ab* may be connected to the port B. At this time, the communication path 156*aa* may be disposed on the side opposite to the port A in a clockwise direction. Accordingly, the recess portion 41*a* of the cap member 41, placed in the sealing state, corresponding to the port B may communicate with the pump 44. In this state, the pump 44 may be driven for the predetermined time to perform the suctioning operation. Thus, ink may be purged from the nozzles 8 of the inkjet head 2 sealed by the recess portion 41*a* corresponding to the port B, into the recess portion 41*a* corresponding to the port B.

Further, the maintenance controller 62 may control the elevation mechanism 42 to bring the cap member 41 corresponding to the port B to the open state from the sealing state, and to maintain the cap member 41 corresponding to the port A in the sealing state (the first sealing state). The maintenance controller 62 may rotate the rotation member 56 clockwise to connect the ports A and B to the communication paths 156*aa* and 156*ab*, respectively, as depicted in FIG. 11B (the first state). Accordingly, the two recess portions 41*a* of the cap members 41 corresponding to the ports A and B may communicate with the pump 44 that is being driven. Accordingly, the idle suctioning operation may be performed for the recess portion 41*a* of the cap member 41, that is place in the open state, corresponding to the port B. The preliminary suctioning operation may be performed for the recess portion 41*a* of the cap member 41, that is placed in the sealing state, corresponding to the port A.

The maintenance controller 62 may wait until the elapsed time since the idle suctioning operation has been started becomes equal to time t1'. The time t1' may be the time for which the idle suctioning operation may be continued. More specifically, the time t1' may be less than or equal to the time required to suction all of the maximum amount of ink that the recess portion 41*a* of the cap member 41 to be subjected to the idle suctioning operation is able to store therein. Accordingly, while ink remaining in the recess portion 41*a* corresponding to the port B is suctioned by the idle suctioning operation, the internal pressures of the recess portions 41*a* corresponding to the ports A and B may be reduced. The idle suctioning operation may stop before all amounts of ink remaining in the recess portion 41*a* corresponding to the port B are suctioned. Accordingly, negative pressure may be maintained in the recess portion 41*a* corresponding to the port A.

Figure 11C:
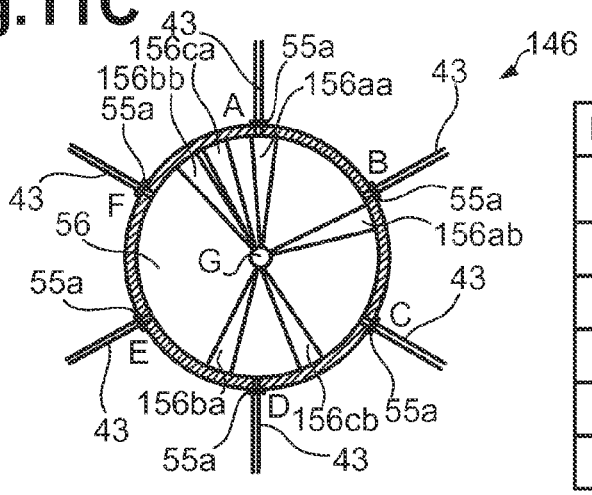

When the maintenance controller 62 determines that the elapsed time becomes equal to the time t1', the maintenance controller 62 may control the elevation mechanism 42 to place the cap members 41 corresponding to the ports A and B in the sealing state. As depicted in FIG. 11C, the maintenance controller 62 may rotate the rotation member 56 clockwise to connect the port A to the communication path 156*aa* while the port B is blocked. Accordingly, the recess portion 41*a* of the cap members 41, placed in the sealing state, corresponding to the port A may communicate with the pump 44 that is being driven. The suctioning operation may be started to purge ink from the nozzles 8 of the inkjet head 2 sealed by the recess portion 41*a* corresponding to the port A. At this time, pressure in the recess portion 41*a* corresponding to the port A may be maintained in the negative pressure by the preliminary suctioning operation that may be preliminary performed before the suctioning operation. Therefore, the pressure in the recess portion 41*a* corresponding to the port A may be promptly reduced to the desired negative pressure with the reduced time, as compared with a case in which the preliminary suctioning operation is not performed. Accordingly, ink may be effectively purged from the nozzles 8 of the inkjet head 2 sealed by the recess portion 41*a* corresponding to the port A.

Thereafter, when the elapsed time since the suctioning operation has been started becomes equal to the time t2, the maintenance controller 62 may control the elevation mechanism 42 to bring the cap member 41 corresponding to the port A to the open state from the sealing state for the idle suctioning operation to be performed after the suctioning operation. At this time, the pump 44 may communicate with one inkjet head 2, corresponding to the port A, that may be subjected to the idle suctioning operation, so that ink remaining in the recess portion 41*a* corresponding to the port A may be effectively suctioned. As a predetermined time has elapsed since the idle suctioning operation has been started to complete suctioning of the ink remaining in the recess portion 41*a*, the maintenance controller 62 may stop driving the pump 44. The maintenance controller 62 may place all cap members 41 in the open state, and then move the elevation mechanism 42 to a position where the elevation mechanism 42 does not oppose the ejection surfaces 2. Then, the purge operation may end.

The printer 1 according to the example embodiment may perform suctioning in the first state, so that the preliminary suctioning operation may be performed at the same time as the idle suctioning operation, to bring the pressure in the recess portion 41*a* of the cap member 41, which is to be subjected to the suctioning operation, to negative pressure. As the preliminary suctioning operation is shifted to the suctioning operation, the pressure in the recess portion 41*a* may be promptly reduced to the predetermined negative pressure, as compared with a case in which pressure in the recess portion 41*a* is not reduced to negative pressure in advance before the suctioning operation is performed. Accordingly, ink may be effectively purged, and the time required to recover ink ejection performances may be reduced.

The time t1' for which the idle suctioning operation may be continued may be the time less than or equal to the time required to suction all of the maximum amount of ink that the recess portion 41*a* of the cap member 41 to be subjected to the idle suctioning operation is able to store therein. Therefore, negative pressure may be maintained in the recess portion 41*a* subjected to the preliminary suctioning operation.

Further, in the purge operations for the arbitrarily selected two inkjet heads 2, the pump 44 may communicate with one port corresponding to the second or last inkjet head 2 subjected to the idle suctioning operation. Therefore, ink remaining in the recess portion 41*a* corresponding to the one port may be effectively suctioned.

The purge operation may be performed for the two inkjet heads 2 that are arbitrarily selected. Therefore, the purge operation may be effectively performed as necessary, to reduce the consumption of ink.

Figure 12:
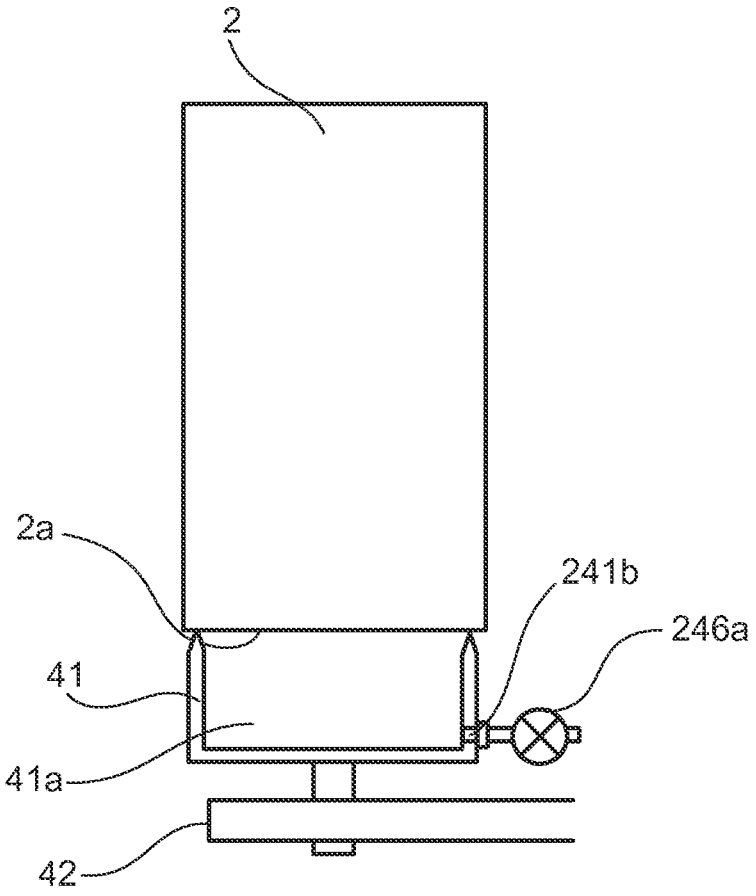
FIG. 12 is a diagram depicting a portion of a modified maintenance unit.

In the above-described example embodiments, an end of the cap member 41 may contact the ejection surface 2*a* (contact state) to bring the cap member 41 in the sealing state. The end of the cap member 41 may be separated from the ejection surface 2*a* (separate state) to bring the cap member 41 in the open state. Alternatively, the state of the cap member 41 may be changed between the sealing state or contact and the open state or separate state with other construction. For example, as depicted in FIG. 12, the cap member 41 may have an air communication path 241*b* formed at a side wall thereof. The air communication path 241*b* may communicate with the air. The cap member 41 may comprise a valve 246*a* configured to open or close the air communication path 241*b*. With such a structure, the valve 246*a* may be open or closed with the cap member 41 contacting the ejection surface 2*a*, to change the state of the cap member 41 between the sealing state and the open state promptly. That is, in this case, even in the contact state in which the cap member 41 is in contact with the ejection surface 2*a*, when the valve 246*a* is closed, it may be in the sealing state, and when the valve 246*a* is opened, it may be in the open state.

Figure 13:
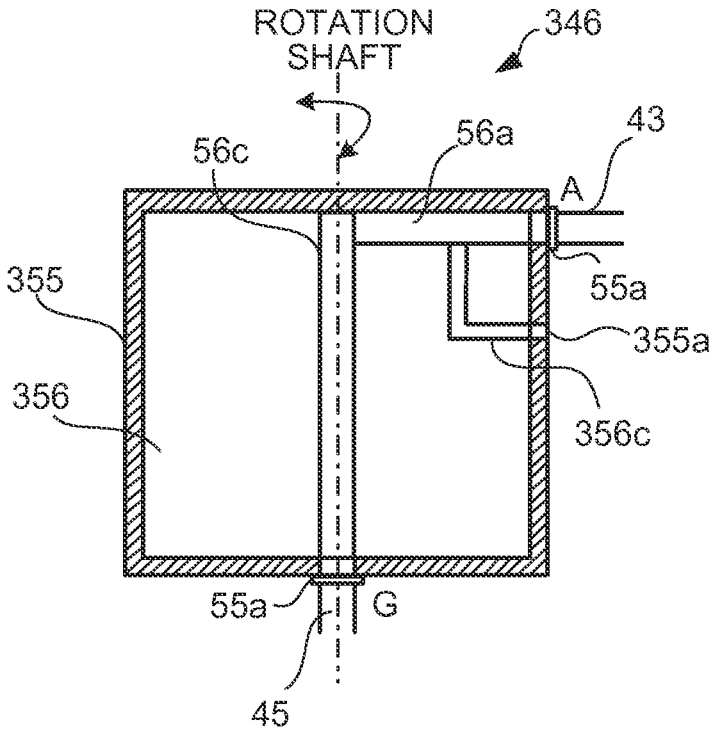
FIG. 13 is a diagram depicting a modified rotary valve.

As depicted in FIG. 13, an outer peripheral surface of a casing 355 of a rotary valve 346 may have an air communication opening 355*a* at a position adjacent to each communication opening 55*a*. A rotation member 356 of the rotary valve 346 may have an air communication path 356*c* that may connect the first flow path 56*a* to the air communication opening 355*a*. The recess portion 41*a* connected to the communication opening 55*a* may communicate with the atmosphere, even with the cap member 41 contacting the ejection surface 2*a*. The control of the elevation mechanism 42 may be simplified. The cross-sectional area of the passage of the air communication opening 355*a* may be set smaller than that of the passage of the first flow path 56*a*, so that the suctioning efficiency in the preliminary suctioning operation may increase.

Figure 14:
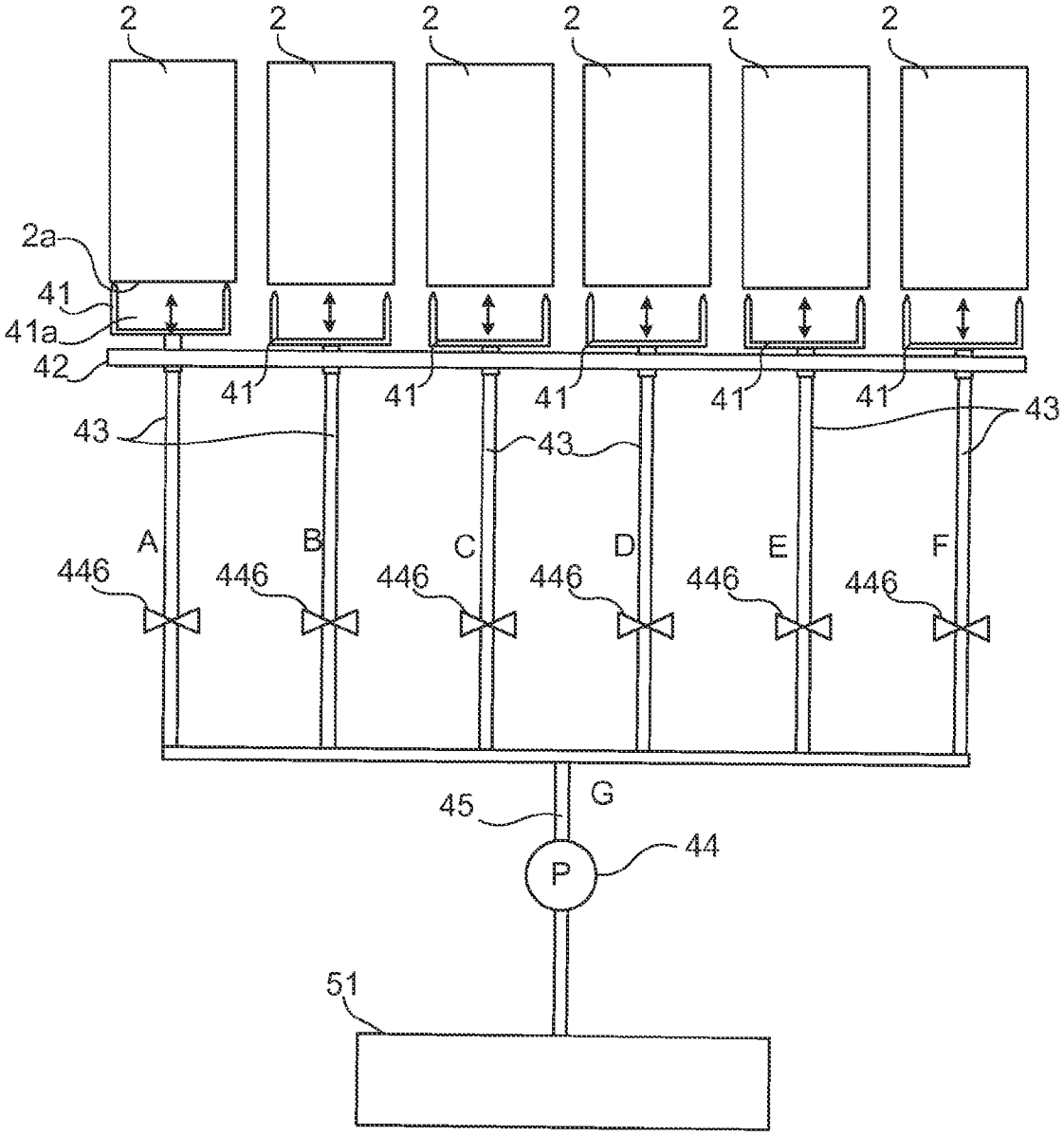
FIG. 14 is a diagram depicting a modified maintenance unit.

In the above-described example embodiments, the rotary valve 46, 146, 346 may be used as a connection device. Alternatively, as depicted in FIG. 14, an opening/closing valve 446 may be provided for each of the suction tubes 43, instead of the rotary valve 46, 146, 346. The maintenance controller 62 may control the opening/closing valves 446 independently to operate similar to the rotary valve 46, 146, 346.

Figure 15A:
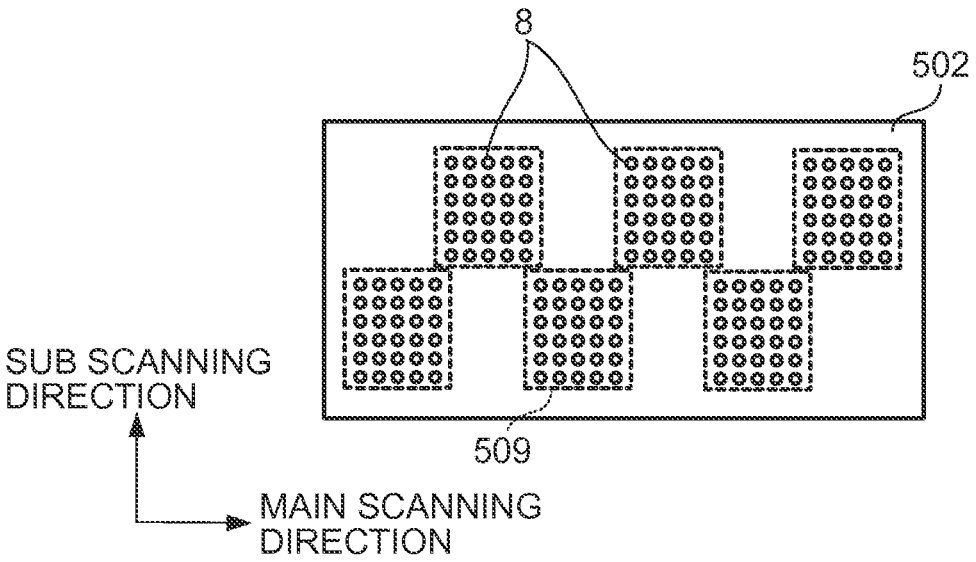
FIG. 15A is a plane view of a nozzle surface of a modified inkjet head.
Figure 15B:
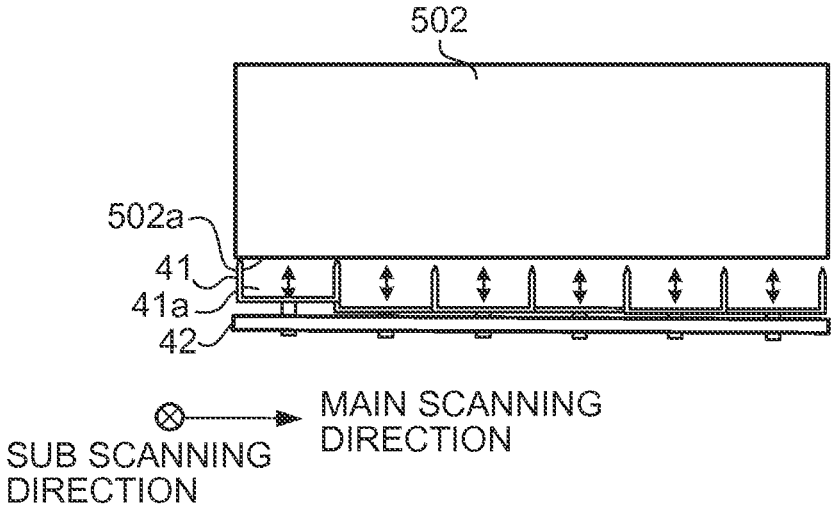
FIG. 15B is a diagram depicting a maintenance unit for the modified inkjet head of FIG. 15A.

In the above-described example embodiment, each inkjet head 2 may be configured to eject ink droplets of different types, e.g., colors. Alternatively, the number of the inkjet heads 2 might not correspond to the number of the types of ink droplets to be ejected. For example, as depicted in FIG. 15A, one inkjet head 502 may be configured to eject ink droplets of six types. With such a structure, six nozzle unit blocks 509, each of which comprising the nozzles 8, may be disposed along the main scanning direction. Each of the nozzle unit blocks 509 may comprise rows of the nozzles 8 according to ink types. As depicted in FIG. 15B, the cap members 41 may seal the nozzles 8 of the corresponding nozzle unit blocks 509. In the above-described example embodiments, the cap members 41 may be arranged in the sub scanning direction. In this modification, the cap members 41 may be arranged in the main scanning direction.

Figure 16:
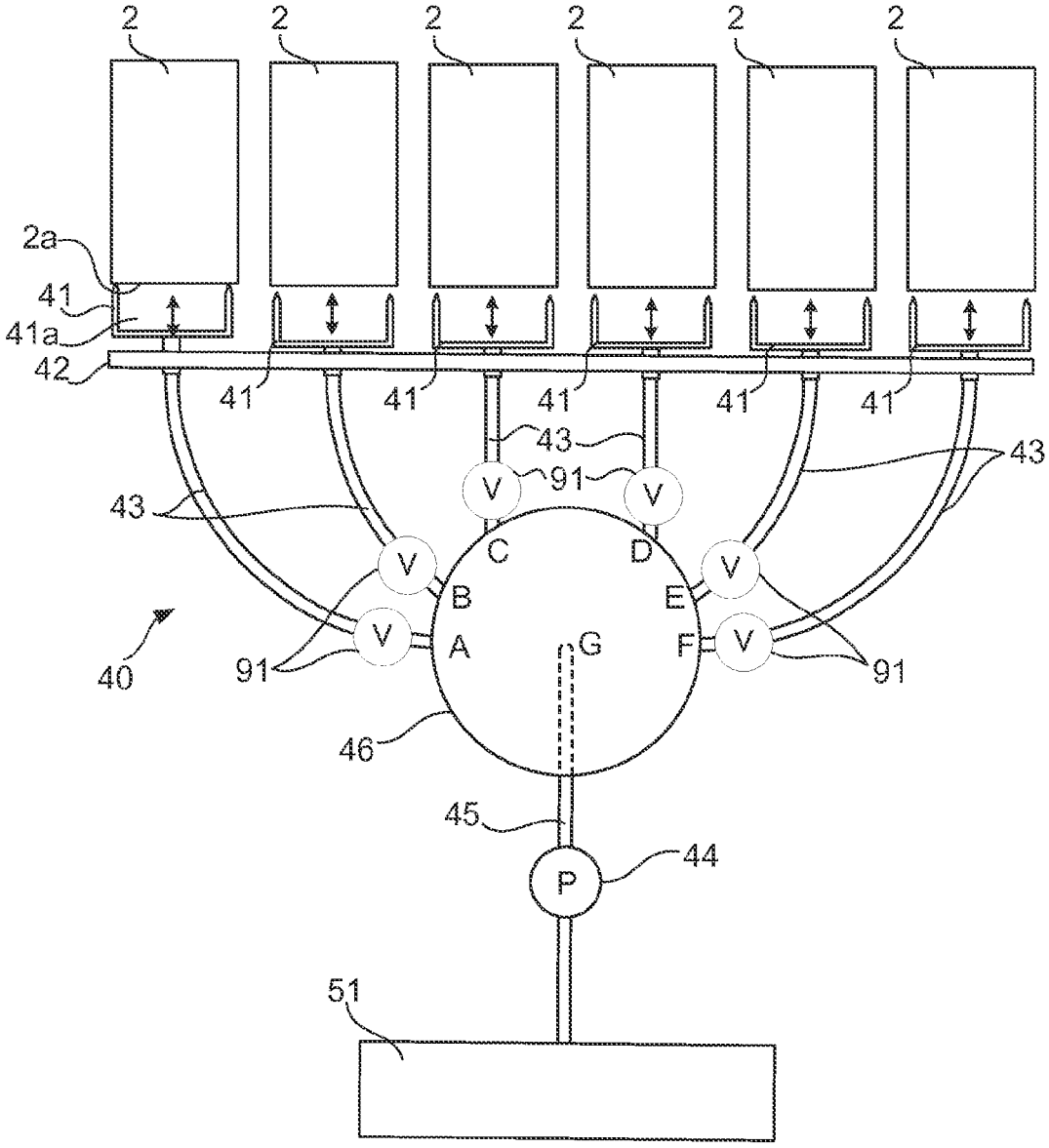
FIG. 16 is a diagram depicting a modified maintenance unit.
Figure 17:
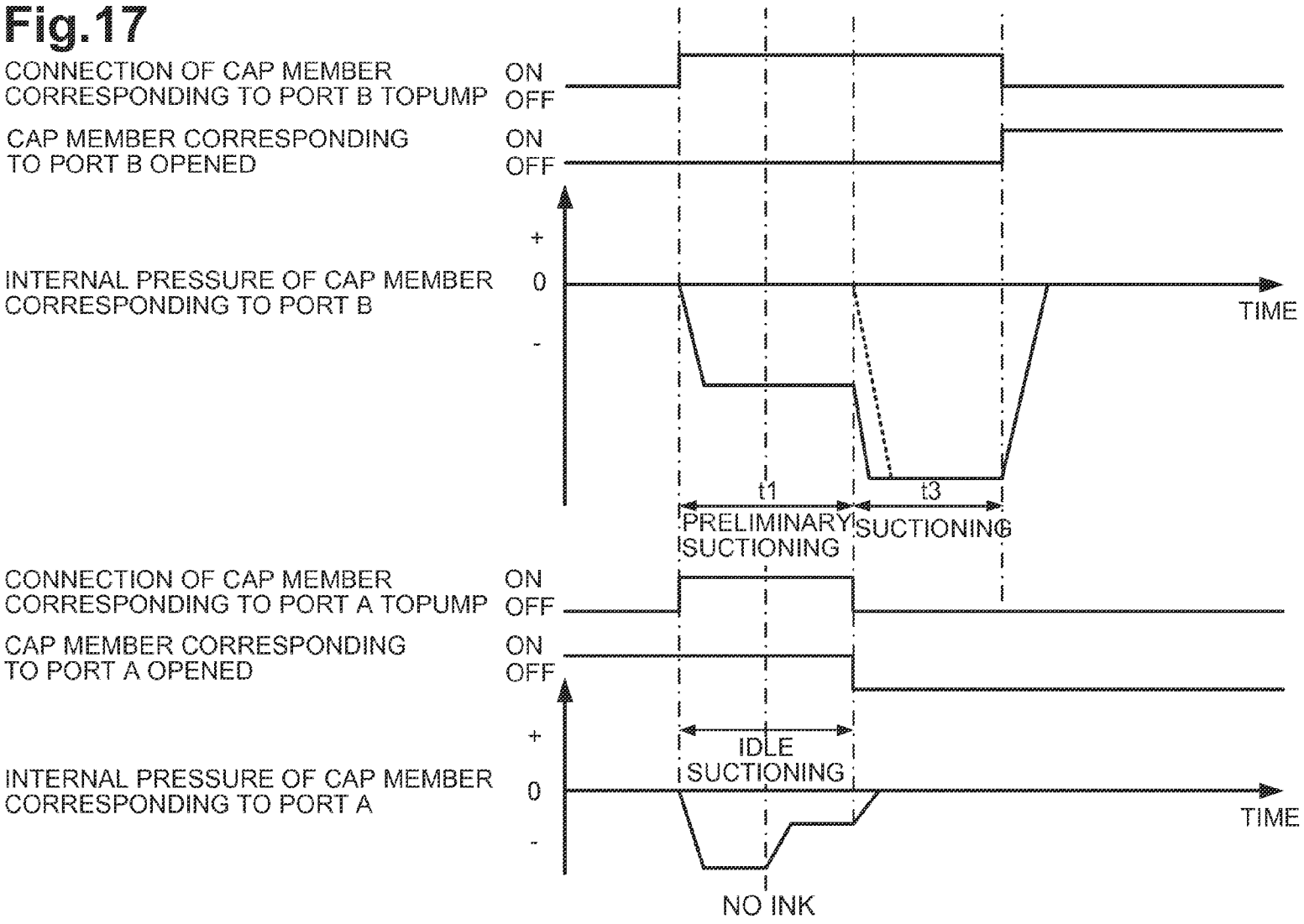
FIG. 17 is a timing chart depicting operations of the maintenance unit of FIG. 16.

As depicted in FIG. 16, a check valve 91 may be provided for each of the six suction tubes 43 in the above-described example embodiment. The check valve 91 may be configured to regulate the movement of fluid from the rotary valve 46 to the corresponding cap member 41. In the construction of FIG. 16, FIG. 17 may correspond to FIG. 9. When the check valves 91 are provided, pressure in the recess portion 41*a* corresponding to the port B might not increase during the preliminary suctioning operation, as depicted in FIG. 17. As compared with a case depicted in FIG. 9 in which the check valves 91 are not provided, pressure in the recess portion 41*a* corresponding to the port B may be reduced more promptly to the desired negative pressure. Consequently, the time t2 of FIG. 9 may be reduced to time t3. Thus, the time in which the ink ejection performance of the nozzles 8 of the inkjet head 2 is recovered may further be reduced.

While the disclosure has been described in detail with reference to the specific embodiments thereof, this is merely an example, and various changes, arrangements and modifications may be applied therein without departing from the spirit and scope of the disclosure.

For example, in the above-described example embodiments, the rotation member 56 may be disposed in the internal space 55*b*, having a hollow cylindrical shape, of the casing 55. The rotation member 56 may be configured to rotate inside the internal space 55*b* along the circumferential direction of the casing 55. The shape of the internal space 55*b* of the casing 55 may have any shape if the rotation member 56 may be rotatable inside the internal space 55*b*. For example, a rotation member having a spherical shape may be configured to rotate inside an interior space of a casing having the spherical shape.

In the first example embodiment, in the rotation member 56 of the rotary valve 46, a cross-sectional area of the passage of the first flow path 56*a* may be smaller than that of the passage of the second flow path 56*b*. Alternatively, a cross-sectional area of the passage of the first flow path 56*a* may be greater or equal to a cross-sectional area of the passage of the second flow path 56*b*.

Further, in the first example embodiments, the maintenance controller 62 may simultaneously start the idle suctioning operation for one inkjet head 2 and the preliminary suctioning operation for another inkjet head 2. Alternatively, the maintenance controller 62 may start the preliminary suctioning operation for another inkjet head 2 after starting the idle suctioning operation for one inkjet head 2.

The second flow path 56*b* of the rotation member 56 according to the first example embodiment and the communication path 156*aa*-156*cb* of the rotation member 56 according to the second example embodiment may be wider in the circumferential direction of the casing 55 as they extend closer to the outer peripheral surface of the casing 55. Alternatively, the paths 56*b*, and 156*aa*-156*cb* may have any shape. For example, the paths 56*b*, and 156*aa*-156*cb* may extend in a uniform width.

Further, in the first and second example embodiments, the ports A-F may be arranged along the outer peripheral surface of the casing 55 at the same height or level. The ports A-F may be disposed in any positional relation. For example, any of the ports A-F may be disposed at a different position in a direction perpendicular to the circumferential direction of the casing 55.

In the first example embodiment, the time t1 may be greater than or equal to the time required to suction the entire maximum amount of ink that the recess portion 41*a* of the cap member 41 to be subjected to the idle suctioning operation is able to store therein. Alternatively, the time t1 may include the time required to suction all amounts of ink in the suction tubes 43 and the waste liquid tube 45, as well. When ink remains in the suction tubes 43 or the waste liquid tube 45 during suctioning, ink adhering to the suction tubes 43 or the waste liquid tube 45 may close or clog the tubes 43, 45 with the passage of time. Therefore, as the time t1 is set to the time required to suction all amounts of ink existing in the suction tubes 43 or the waste liquid tube 45 as well, such possibilities that the suction tube 43 or the waste liquid tube 45 is closed or clogged may be reduced.

In the example embodiments, the control device 1*p* may comprise the CPU 71. In another embodiment, the control device 1*p* may comprise one or more CPUs 71, one or more application specific integrated circuits ("ASICs"), or a combination of one or more CPUs 71 and one or more ASICs.

The disclosure may be applied to other devices, e.g., facsimile machines, copiers, and the life, in addition to printers. The inkjet head 2 may be configured to eject other liquid or fluid than ink. The recording medium may not be limited to the sheet P but may include any recording media for printing.

While the invention has been described in connection with embodiments of the invention, it will be understood by those skilled in the art that variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A liquid ejection head comprising:

a plurality of nozzle units, each nozzle unit comprising one or more nozzles for ejecting liquid therefrom;

a plurality of capping devices, each capping device configured to seal a corresponding nozzle unit of the plurality of nozzle units from an external space;

a movement mechanism configured to move each capping device relative to the liquid ejection head to place each capping device in a contact state in which the capping device is in contact with the liquid ejection head or a separate state in which the capping device is separated from the liquid ejection head;

a plurality of suctioning tubes, each suctioning tube connected to a corresponding respective one of the plurality of capping devices;

a suctioning mechanism configured to suction fluid in the capping device by generating a suctioning force;

a connection device configured to connect the suctioning mechanism to each of the plurality of suctioning tubes, the connection device comprising a rotation member, the rotation member comprising a first flow path and a second flow path that are each configured to rotate with the rotation member; and a control device configured to:

control the connection device and the movement mechanism to place the liquid ejection apparatus in a first state in which:

the suctioning mechanism is connected to a first suctioning tube, of the plurality of suctioning tubes, via the first flow path to suction fluid in the capping device corresponding to one of the plurality of nozzle units in an unsealing state in which the one of the plurality of nozzle units is not sealed from the external space, wherein the first suctioning tube is connected to the capping device corresponding to the one of the plurality of nozzle units, and the suctioning mechanism is connected to a second suctioning tube, of the plurality of suctioning tubes, via the second flow path to suction fluid in the capping device corresponding to a different one of the plurality of nozzle units in a sealing state in which the different one of the plurality of nozzle units is sealed from the external space, wherein the second suctioning tube is connected to the capping device corresponding to the different one of the plurality of nozzle units;

control the suctioning mechanism to suction fluid in the capping device corresponding to the one of the plurality of nozzle units and to suction fluid in the capping device corresponding to the different one of the plurality of nozzle units in the first state; and control the connection device to rotate the rotation member to place the liquid ejection apparatus in a second state in which:

the first suctioning tube is disconnected from the suctioning mechanism in response to expiration of a predetermined time period, the predetermined time period being a predetermined amount of time that the suctioning mechanism generates the suctioning force in the first state, and the second suctioning tube is connected to the suctioning mechanism via the second flow path;

control the connection device and the movement mechanism to rotate the rotation member to place the liquid ejection apparatus in a third state in which:

the suctioning mechanism is disconnected from the first suctioning tube, and the suctioning mechanism is connected to the second suctioning tube via the first flow path to suction fluid in the capping device corresponding to the different one of the plurality of nozzle units in an unsealing state in which the different one of the plurality of nozzle units is not sealed from the external space; and control the suctioning mechanism to suction fluid in the capping device corresponding to the different one of the plurality of nozzle units in the third state, wherein the liquid election apparatus is placed in the third state in response to expiration of another predetermined time period, the other predetermined time period being a predetermined amount of time that the suctioning mechanism generates the suctioning force in the second state.

2. The liquid ejection apparatus according to claim 1, the connection device further comprises:

a casing that has a plurality of communication openings through which an internal space is in communication with the external space, wherein the rotation member is configured to rotate inside the internal space of the casing, wherein each of the plurality of suctioning tubes is connected to the one of the plurality of communication openings respectively, and sequentially, as the rotation member rotates in one direction:

the second flow path is configured to communicate with a first communication opening of the plurality of communication openings, and the second flow path is configured to communicate with the first communication opening and the first flow path is configured to communicate with a second communication opening of the plurality of communication openings, and wherein the control device is configured to rotate the rotation member in the one direction to connect the suctioning mechanism and at least one of the plurality of suctioning tubes.

3. The liquid ejection apparatus according to claim 1, wherein the control device is further configured to control the suctioning mechanism to suction fluid in the capping device corresponding to the different one of the nozzle units in the second state.

4. The liquid ejection apparatus according to claim 3, wherein, in response to expiration of a further predetermined time period, the further predetermined time period being a predetermined amount of time that the liquid ejection apparatus is in the second state, the control device is further configured to:

control the suctioning mechanism to suction fluid in the capping device corresponding to the different one of the nozzle units in the unsealing state; and control the connection device to connect the suctioning mechanism to the suctioning tube connected to the capping device corresponding to another one of the nozzle units.

5. The liquid ejection apparatus according to claim 1, wherein a suctioning time period is greater than or equal to a time required to suction all of a maximum amount of liquid in the capping device corresponding to the one of the plurality of nozzle units, in the first state.

6. The liquid ejection apparatus according to claim 1, wherein a cross-sectional area of the first flow path is less than a cross-sectional area of the second flow path.

7. The liquid ejection apparatus according to claim 2, wherein the connection device further comprises a connection path configured to connect the flow path to the external space.

8. The liquid ejection apparatus according to claim 7, wherein a cross-sectional area of the connection path is less than a cross-sectional area of at least one of the first flow path and the second flow path.

9. The liquid ejection apparatus according to claim 1, wherein the control device is configured to:

control the movement mechanism such that an end portion of the capping device is in contact with the liquid ejection head to seal the corresponding nozzle unit in the sealing state;

control the movement mechanism such that an end portion of the capping device is separate from the liquid ejection head to unseal the corresponding nozzle unit in the unsealing state.

10. The liquid ejection apparatus according to claim 1, wherein the capping device further comprises an air communication path configured to connect an internal space of the capping device to the external space and an air communication valve configured to open and close the air communication path, wherein the control device is configured to:

control the movement mechanism and the capping device such that an end portion of the capping device is in contact with the liquid ejection head and the air communication path is closed from the external space by the air communication valve to seal the corresponding nozzle unit in the sealing state;

control the movement mechanism and the capping device such that an end portion of the capping device is in contact with the liquid ejection head and the air communication path is open to the external space by the air communication valve to unseal the corresponding nozzle unit in the unsealing state.

11. The liquid ejection apparatus according to claim 1, wherein the control device is further configured to control the movement mechanism such that each of the capping devices that is not connected to the suctioning mechanism is in the sealing state.

12. The liquid ejection apparatus according to claim 1, wherein each of the plurality of suctioning tubes comprises a check valve configured to regulate movement of fluid from the suctioning mechanism to each of the capping devices, respectively.

13. The liquid ejection apparatus according to claim 1, wherein the control device is configured to:

control the connection device and the movement mechanism to place the liquid ejection apparatus in another state in which the suctioning mechanism is connected to the first suctioning tube, of the plurality of suctioning tubes, via the second flow path to suction fluid in the capping device corresponding to the one of the plurality of nozzle units in the sealing state; and control the suctioning mechanism to suction fluid in the capping device corresponding to the one of the plurality of nozzle units, wherein the liquid ejection apparatus is placed in the first state in response to expiration of another predetermined time period, the another predetermined time period being a predetermined amount of time that the suctioning mechanism generates the suctioning force in the other state.

14. A non-transitory, computer-readable storage medium storing computer-readable instructions therein that, when executed by at least one processor of a liquid ejection apparatus comprising a liquid ejection head comprising a plurality of nozzle units, each nozzle unit comprising one or more nozzles for ejecting liquid therefrom; a plurality of capping devices, each capping device configured to seal a corresponding nozzle unit of the plurality of nozzle units from an external space; a movement mechanism configured to move each capping device relative to the liquid ejection head to place each capping device in a contact state in which the capping device is in contact with the liquid ejection head or a separate state in which the capping device is separated from the liquid ejection head; a plurality of suctioning tubes, each suctioning tube connected to a corresponding respective one of the plurality of capping devices; a suctioning mechanism configured to suction fluid in the capping device by generating a suctioning force; a connection device configured to connect the suctioning mechanism to each of the plurality of suctioning tubes, the connection device comprising a rotation member, the rotation member comprising a first flow path and a second flow path that are each configured to rotate with the rotation member, instruct the liquid ejection apparatus to execute processes, comprising:

controlling the connection device and the movement mechanism to place the liquid ejection apparatus in a first state in which:

the suctioning mechanism is connected to a first suctioning tube, of the plurality of suctioning tubes, via the first flow path to suction fluid in the capping device corresponding to the one of the plurality of nozzle units in an unsealing state in which the one of the plurality of nozzle units is not sealed from the external space, wherein the first suctioning tube is connected to the capping device corresponding to the one of the plurality of nozzle units, and the suctioning mechanism is connected to a second suctioning tube, of the plurality of suctioning tubes, via the second flow path to suction fluid in the capping device corresponding to a different one of the plurality of nozzle units in a sealing state in which the different one of the plurality of nozzle units is sealed from the external space, wherein the second suctioning tube is connected to the capping device corresponding to the different one of the plurality of nozzle units;

controlling the suctioning mechanism to suction fluid in the capping device corresponding to the one of the plurality of nozzle units and to suction fluid in the capping device corresponding to the different one of the plurality of nozzle units in the first state;

controlling the connection device to rotate the rotation member to place the liquid ejection apparatus in a second state in which:

the first suctioning tube is disconnected from the suctioning mechanism after expiration of a predetermined time period, the predetermined time period being a predetermined amount of time that the suctioning mechanism generates the suctioning force in the first state, and the second suctioning tube is connected to the suctioning mechanism via the second flow path;

controlling the connection device and the movement mechanism to rotate the rotation member to place the liquid election apparatus in a third state in which:

the suctioning mechanism is disconnected from the first suctioning tube, and the suctioning mechanism is connected to the second suctioning tube via the first flow path to suction fluid in the capping device corresponding to the different one of the plurality of nozzle units in an unsealing state in which the different one of the plurality of nozzle units is not sealed from the external space; and controlling the suctioning mechanism to suction fluid in the capping device corresponding to the different one of the plurality of nozzle units in the third state, wherein the liquid ejection apparatus is placed in the third state in response to expiration of another predetermined time period, the other predetermined time period being a predetermined amount of time that the suctioning mechanism generates the suctioning force in the second state.

15. A method of maintaining a liquid ejection apparatus comprising a liquid ejection head comprising a plurality of nozzle units, each nozzle unit comprising one or more nozzles for ejecting liquid therefrom; a plurality of capping devices, each capping device configured to seal a corresponding nozzle unit of the plurality of nozzle units from an external space; a movement mechanism configured to move each capping device relative to the liquid ejection head to place each capping device in a contact state in which the capping device is in contact with the liquid ejection head or a separate state in which the capping device is separated from the liquid ejection head; a plurality of suctioning tubes, each suctioning tube connected to a corresponding respective one of the plurality of capping devices; a suctioning mechanism configured to suction fluid in the capping device by generating a suctioning force; a connection device configured to connect the suctioning mechanism to each of the plurality of suctioning tubes, the connection device comprising a rotation member, the rotation member comprising a first flow path and a second flow path that are each configured to rotate with the rotation member, and a control device, the method comprising:

controlling the connection device and the movement mechanism to place the liquid ejection apparatus in a first state in which:

the suctioning mechanism is connected to a first suctioning tube, of the plurality of suctioning tubes, via the first flow path to suction fluid in the capping device corresponding to one of the plurality of nozzle units in an unsealing state in which the one of the plurality of nozzle units is not sealed from the external space, wherein the first suctioning tube is connected to the capping device corresponding to the one of the plurality of nozzle units, and the suctioning mechanism is connected to a second suctioning tube, of the plurality of suctioning tubes, via the second flow path to suction fluid in the capping device corresponding to a different one of the plurality of nozzle units in a sealing state in which the different one of the plurality of nozzle units is sealed from the external space, wherein the second suctioning tube is connected to the capping device corresponding to the different one of the plurality of nozzle units;

controlling the suctioning mechanism to suction fluid in the capping device corresponding to the one of the plurality of nozzle units and to suction fluid in the capping device corresponding to the different one of the plurality of nozzle units in the first state;

controlling the connection device to rotate the rotation member to place the liquid ejection apparatus in a second state in which:

the first suctioning tube is disconnected from the suctioning mechanism after expiration of a predetermined time period, the predetermined time period being a predetermined amount of time that the suctioning mechanism generates the suctioning force in the first state, and the second suctioning tube is connected to the suctioning mechanism via the second flow path;

controlling the connection device and the movement mechanism to rotate the rotation member to place the liquid ejection apparatus in a third state in which:

the suctioning mechanism is disconnected from the first suctioning tube, and the suctioning mechanism is connected to the second suctioning tube via the first flow path to suction fluid in the capping device corresponding to the different one of the plurality of nozzle units in an unsealing state in which the different one of the plurality of nozzle units is not sealed from the external space; and controlling the suctioning mechanism to suction fluid in the capping device corresponding to the different one of the plurality of nozzle units in the third state, wherein the liquid election apparatus is placed in the third state in response to expiration of another predetermined time period, the other predetermined time period being a predetermined amount of time that the suctioning mechanism generates the suctioning force in the second state.

16. The liquid ejection apparatus according to claim 1, wherein, when the liquid ejection apparatus is in the second state, the suctioning mechanism is configured to suction fluid in the capping device corresponding to the different one of the plurality of nozzle units in the sealing state in which the different one of the plurality of nozzle units is sealed from the external space.

17. A liquid ejection apparatus comprising:

a liquid ejection head comprising a plurality of nozzle units, each nozzle unit comprising one or more nozzles for ejecting liquid therefrom;

a plurality of capping devices, each capping device configured to seal a corresponding nozzle unit of the plurality of nozzle units from an external space;

a movement mechanism configured to move each capping device relative to the liquid ejection head to place each capping device in a contact state in which the capping device is in contact with the liquid ejection head or a separate state in which the capping device is separated from the liquid ejection head;

a plurality of suctioning tubes, each suctioning tube connected to a corresponding respective one of the plurality of capping devices;

a suctioning mechanism configured to suction fluid in the capping device by generating a suctioning force;

a connection device configured to connect the suctioning mechanism to each of the plurality of suctioning tubes; and a control device configured to:

control the connection device and the movement mechanism to place the liquid ejection apparatus in a first state in which the suctioning mechanism is connected to a first suctioning tube, of the plurality of suctioning tubes, connected to the capping device corresponding to one of the plurality of nozzle units, to suction fluid in the capping device corresponding to the one of the plurality of nozzle units in an unsealing state in which the one of the plurality of nozzle units is not sealed from the external space, and the suctioning mechanism is connected to a second suctioning tube, of the plurality of suctioning tubes, connected to the capping device corresponding to a different one of the plurality of nozzle units, to suction fluid in the capping device corresponding to the different one of the plurality of nozzle units in a sealing state in which the different one of the plurality of nozzle units is sealed from the external space, wherein the capping device corresponding to the one of the plurality of nozzle units is in the separate state when the one of the plurality of nozzle units is in the unsealing state;

control the suctioning mechanism to suction fluid in the capping device corresponding to the one of the plurality of nozzle units and to suction fluid in the capping device corresponding to the different one of the plurality of nozzle units in the first state; and control the connection device to place the liquid ejection apparatus in a second state in which the first suctioning tube connected to the capping device corresponding to the one of the plurality of nozzle units is disconnected from the suctioning mechanism in response to expiration of a predetermined time period, the predetermined time period being a predetermined amount of time that the suctioning mechanism generates the suctioning force in the first state, wherein the second suctioning tube connected to the capping device corresponding to the different one of the plurality of nozzle units is connected to the suctioning mechanism in the second state.

* * * * *